US007682205B2

(12) United States Patent
Hall et al.

(10) Patent No.: US 7,682,205 B2
(45) Date of Patent: Mar. 23, 2010

(54) MULTI POSITION ELECTRICAL CONNECTOR ASSEMBLY

(75) Inventors: John Wesley Hall, Harrisburg, PA (US); Douglas John Hardy, Middletown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/270,497

(22) Filed: Nov. 13, 2008

(65) Prior Publication Data

US 2009/0130902 A1 May 21, 2009

Related U.S. Application Data

(60) Provisional application No. 61/003,174, filed on Nov. 15, 2007.

(51) Int. Cl.
*H01R 13/514* (2006.01)

(52) U.S. Cl. ..... 439/752

(58) Field of Classification Search ..... 439/752, 439/595

See application file for complete search history.

(56) References Cited

U.S. PATENT DOCUMENTS 4,655,534 A * 4/1987 Stursa ..... 439/582
4,750,893 A * 6/1988 Sueyoshi et al. ..... 439/596
4,979,913 A * 12/1990 Aiello et al. ..... 439/596
5,076,806 A * 12/1991 Hotea et al. ..... 439/595
5,098,315 A * 3/1992 Scowen ..... 439/587
5,280,254 A * 1/1994 Hunter et al. ..... 333/124
5,382,173 A * 1/1995 Brown et al. ..... 439/188
5,389,014 A * 2/1995 Kumpel et al. ..... 439/752
5,403,213 A * 4/1995 Inaba et al. ..... 439/752
5,643,009 A * 7/1997 Dinkel et al. ..... 439/595
5,647,775 A * 7/1997 Polgar et al. ..... 439/752
5,662,488 A * 9/1997 Alden ..... 439/314
5,702,262 A * 12/1997 Brown et al. ..... 439/188
5,928,038 A * 7/1999 Berg et al. ..... 439/752
5,993,230 A * 11/1999 Gauker et al. ..... 439/188
6,083,057 A * 7/2000 Annecke et al. ..... 439/752
6,276,957 B1 * 8/2001 Seko et al. ..... 439/489
6,322,391 B1 11/2001 Kodama
6,419,510 B2 * 7/2002 Shiraki et al. ..... 439/188
6,439,914 B2 * 8/2002 Nimura ..... 439/352
6,450,829 B1 * 9/2002 Weisz-Margulescu ..... 439/352
6,676,445 B2 * 1/2004 Hall et al. ..... 439/582
6,743,051 B2 * 6/2004 Hayashi ..... 439/620.05
6,824,403 B2 * 11/2004 Hall et al. ..... 439/108

(Continued)

FOREIGN PATENT DOCUMENTS

EP 1 296 417 3/2003

*Primary Examiner*—T C Patel
*Assistant Examiner*—Vladimir Imas

(57) ABSTRACT

An electrical connector assembly includes a housing having more than one cavity extending along an insertion axis for inserting a connector in each of the more than one cavity. The housing has a slot extending perpendicular to the insertion axis and the housing has a locking chamber therethrough including a first section and a wider second section. A retention lock is inserted into the slot and held within the housing. The retention lock has a split center post with a top latch and the retention lock passes through the locking chamber so that the top latch locks within the wider second section of the locking chamber. The retention lock locks each of the more than one connector within each cavity.

20 Claims, 18 Drawing Sheets

U.S. PATENT DOCUMENTS

| | | | | |
|---|---|---|---|---|
| 6,872,100 | B2 * | 3/2005 | Correll et al. | 439/752 |
| 6,881,102 | B2 * | 4/2005 | Correll et al. | 439/752 |
| 7,056,160 | B2 * | 6/2006 | Correll et al. | 439/752.5 |
| 7,223,131 | B2 | 5/2007 | Moll et al. | |
| 7,347,742 | B2 | 3/2008 | Hall et al. | |
| 7,347,745 | B1 | 3/2008 | Raudenbush et al. | |
| 7,455,542 | B2 * | 11/2008 | Norwood et al. | 439/315 |
| 2002/0042232 | A1 | 4/2002 | Mitani | |
| 2007/0054543 | A1 | 3/2007 | Moll et al. | |
| 2008/0188123 | A1 * | 8/2008 | Hall et al. | 439/569 |

* cited by examiner

MULTI POSITION ELECTRICAL CONNECTOR ASSEMBLY

CROSS REFERENCE TO RELATED APPLICATIONS

This application claims the benefit of U.S. Provisional Application No. 61/003,174 filed Nov. 15, 2007 titled "MULTI POSITION ELECTRICAL CONNECTOR ASSEMBLY", the subject matter of which is herein incorporated by reference in its entirety.

BACKGROUND OF THE INVENTION

The subject matter herein relates generally to electrical connectors and, more particularly, to multiposition connector assemblies having internal retention features.

Radio frequency (RF) coaxial cable connector assemblies have been used for numerous automotive applications, such as global positioning systems (GPS), car radios, mobile phones, air bag warning systems, and multimedia devices. Coaxial cables typically consist of an outer conductor, an inner conductor, a dielectric, and a jacket. The outer conductor and the inner conductor of the cable often electrically interface with a mating coaxial cable through jack and plug connectors. Such conventional coaxial cable connectors are known in the art, for example, in U.S. Pat. Nos. 6,676,445 and 6,824,403, which are assigned to the assignee of the present invention and are expressly incorporated by reference herein.

Other types of electrical connectors have wire terminal contacts used to terminate a wire. For example, a wire contact may have a crimp end for terminating to the wire and a male or female mating end. Some contacts may be developed from metal plating which is stamped and then folded or formed into the appropriate shape. These contacts have a generally box shaped mating end for mating to a contact having a pin or blade type mating end. The contact box mating end has external size and shape requirements to fit into a cavity of a connector and an internal design for providing the mechanical and electrical connection means for receiving and holding the pin or blade contact of the mating contact. In current contacts having generally boxed shaped mating ends, a contact or compliant beam may be the means to receive and hold the pin contact.

Certain automotive applications may require that multiple cables and/or wires be coupled through a single connector assembly. For example, multiple position connector assemblies may be used to electrically couple two coaxial jack connectors with two coaxial plug connectors. Likewise, one connector assembly may be used to electrically couple one coaxial connector and one wire terminal connector.

Typically, electrical connector assemblies have retention means in a housing in order to secure the electrical connectors therein. One such retainer is a plastic movable member which is configured to move in place over the connector to lock the connector in place. Some of such movable members are moved transversely to the axial direction, while others are designed as hinged flaps which are rotated into place. Examples of such electrical connector assemblies include U.S. Pat. Nos. 7,347,745, 7,223,131 and 7,347,742.

However, these retainers may be placed over the connector housing, which may increase the space required for the connectors. Additionally, these retainers may be difficult to remove from the housing. Additionally, the electrical connectors must be aligned within the housing for proper insertion of the retention means. What is needed is a multi-position electrical connector assembly having an internal retention feature and that is easy to assemble.

BRIEF DESCRIPTION OF THE INVENTION

In one embodiment, an electrical connector assembly is provided that includes a housing having more than one cavity extending along an insertion axis for inserting a connector in each of the more than one cavity. The housing has a slot extending perpendicular to the insertion axis and the housing has a locking chamber therethrough including a first section and a wider second section. A retention lock is inserted into the slot and held within the housing. The retention lock has a split center post with a top latch and the retention lock passes through the locking chamber so that the top latch locks within the wider second section of the locking chamber. The retention lock locks each of the more than one connector within each cavity.

Optionally, the retention lock may engage each connector for at least 120 degrees around the circumference of the connector. The housing may include primary retention features for locking each connector in each cavity. Optionally, the slot may include at least one rail extending across the slot parallel to the insertion axis. The retention lock may include at least one slot aligned with, and receiving, the at least one rail. The retention lock may have outer legs for secondary locking of the connectors in the cavities.

In another embodiment, an electrical connector assembly is provided including a housing having connector cavities extending along parallel insertion axes with axis bisectors being defined between adjacent insertion axes. The housing has a locking chamber opening to each of the connector cavities. A plurality of connectors are received in the connector cavities with at least one of the connectors being an Sub-Miniature version B (SMB) connector having a cylindrical body and a lock engagement surface. A retention lock is received in the locking chamber to hold each of the connectors in the respective connector cavities against movement in a direction along the respective insertion axes. The retention lock includes a post extending through each axis bisector, and the retention lock directly engages the lock engagement surface to secure the SMB connector in the housing.

In a further embodiment, an electrical connector assembly is provided that includes a housing having connector cavities extending along parallel insertion axes. The housing has primary retention features extending into the connector cavities and a locking chamber opening to each of the connector cavities. An SMB connector is received in one of the connector cavities and is held therein by one of the primary retention features. The SMB connector has a cylindrical body and a lock engagement surface. A wire terminal connector is received in one of the connector cavities and has a lock engagement surface, wherein one of the primary retention features engages the lock engagement surface. A retention lock is received in the locking chamber to hold each of the connectors in the respective connector cavities. The retention lock has a first leg engaging the lock engagement surface of the SMB connector to hold the SMB connector in the connector cavity, and the retention lock has a second leg engaging the primary retention feature that engages the lock engagement surface of the wire terminal connector for secondary locking of the primary retention feature.

DETAILED DESCRIPTION OF THE INVENTION

Figure 1:
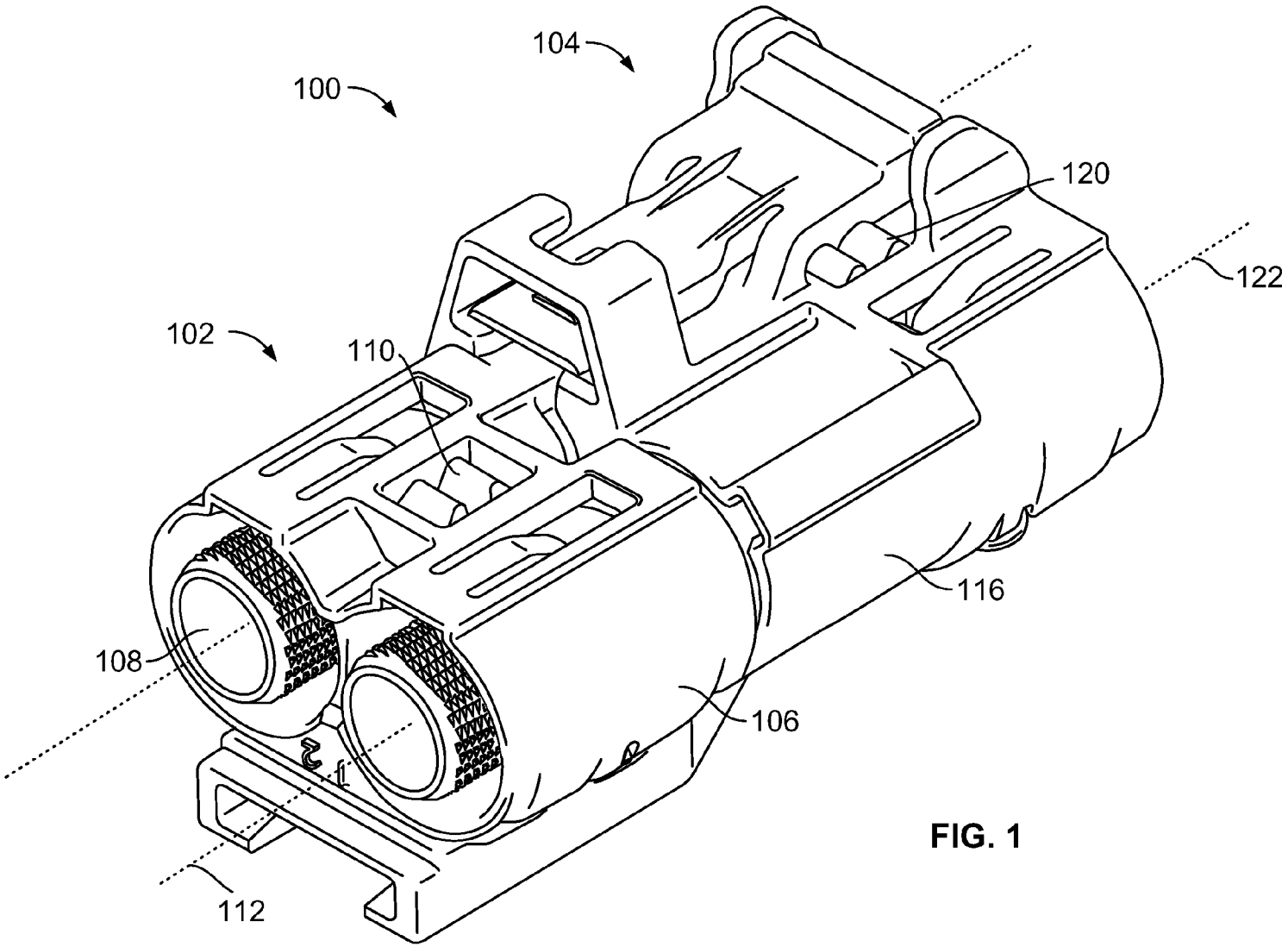
FIG. 1 is an assembled perspective view of an electrical connector system illustrating an exemplary jack assembly and an exemplary plug assembly.

FIG. 1 is an assembled perspective view of an electrical connector system 100 illustrating an exemplary jack assembly 102 and an exemplary plug assembly 104. The jack and plug assemblies 102, 104 are mated together to form an electrical connection therebetween. The jack assembly 102 includes a jack housing 106 and a plurality of jack connectors 108 received in the jack housing 106. A jack retention lock 110 is used to secure the jack connectors 108 in the jack housing 106. The plug assembly 104 includes a plug housing 116 and a plurality of plug connectors 118 (shown in FIG. 2) received in the plug housing 116. A plug retention lock 120 is used to secure the plug connectors 118 in the plug housing 116.

The jack and plug assemblies 102, 104 both include multiple connectors 108, 118 for making more than one connection using one connector system 100. In the illustrated embodiment, the jack and plug assemblies 102, 104 define two position assemblies holding two connectors 108, 118 each. The connectors 108, 118 may be either signal or power connectors, e.g., coaxial cable connectors or wire termination type connectors. In the illustrated embodiment, the connector system 100 represents a radio frequency (RF) coaxial cable connector system used for an automotive application, such as a global positioning system (GPS), a car radio system, a mobile phone system, an air bag warning system, a multimedia device system, and the like. However, the subject matter herein is not intended to be limited to a connector system for an automotive application, and the connector system 100 illustrated in the Figures is but one exemplary embodiment. Optionally, the jack and plug housings 106, 116 and the jack and plug connectors 108, 118 may define a mating interface designed to meet a standard, such as the FAKRA standard.

Figure 2:
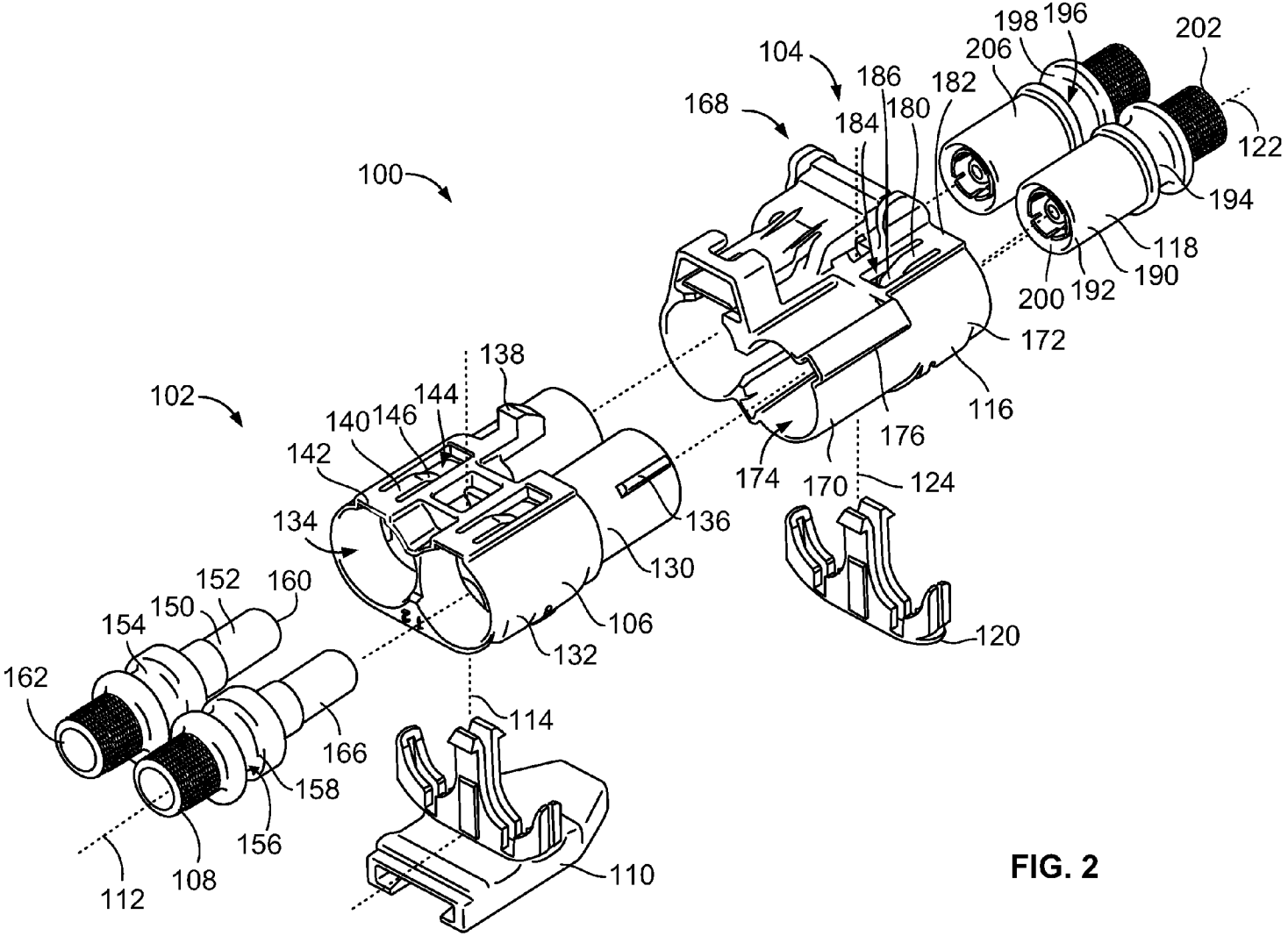
FIG. 2 is an exploded perspective view of the electrical connector system shown in FIG. 1.

FIG. 2 is an exploded perspective view of the electrical connector system 100 illustrating both the jack assembly 102 and the plug assembly 104. FIG. 2 illustrates the jack housing 106 and the jack connectors 108 that are loaded into the jack housing 106 along connector insertion axes 112. The jack retention lock 110 is shown aligned with the jack housing 106 prior to loading into the jack housing 106 in an insertion direction along a lock insertion axis 114. FIG. 2 also illustrates the plug housing 116 and the plug connectors 118 that are loaded into the plug housing 116 along connector insertion axes 122. The plug retention lock 120 is shown aligned with the plug housing 116 prior to loading into the plug housing 116 in an insertion direction along a lock insertion axis 124.

The jack housing 106 includes a mating section 130 and a connector retention section 132. A connector cavity 134 extends along the insertion axis 112 through both the mating section 130 and the connector retention section 132. The connector cavity 134 receives the jack connector 108 and the jack housing 106 and jack retention lock 110 cooperate to hold the jack connector 108 in the connector cavity 134. In the illustrated two position connector system 100, the jack assembly 102 includes two connector cavities 134 for holding two jack connectors 108. The mating section 130 mates to the plug housing 16 and may have keying features 136 to assure proper alignment with the plug assembly 104 and/or to verify mating to the correct plug assembly 104. The mating section 130 may have a catch 138 for locking the jack assembly 102 to the plug assembly 104.

The connector retention section 132 includes at least one primary retention feature 140 for locating and holding the jack connector 108 within the connector cavity 134. In an exemplary embodiment, the jack housing 106 includes a primary retention feature 140 for each connector cavity 134. The primary retention feature 140 is a curved beam extending from an outer surface 142 of the connector retention section 132 through an opening 144 in the jack housing 106 to a locking end 146 located within the connector cavity 134. The primary retention feature 140 holds the jack connector 108 in an installed position until the jack retention lock 110 is set in the final position. The primary retention feature 140 and the jack retention lock 110 cooperate to hold the jack connector 108 in the jack housing 106.

Each jack connector 108 includes a body 150 having an outer surface 152. In an exemplary embodiment, the jack connectors 108 are identical to one another, however the jack connectors 108 may be different from one another in alternative embodiments. In the illustrated embodiment, the jack connectors 108 are SubMiniature version B (SMB) connectors for radio-frequency circuits, however other types of connectors may be used in alternative embodiments. The jack connectors 108 may be coaxial cable connectors, however are not limited to coaxial cable connectors. The outer surface 152 of the body 150 is generally cylindrical along a central axis that coincides with the insertion axis 112. The outer surface 152 is stepped along the length of the body 150 such that the body 150 does not have a uniform cross section along the length. The outer surface 152 defines at least one lock engagement surface 154 configured to engage the retention lock 110 and/or the primary retention feature 140 as will be described in further detail below. In the illustrated embodiment, the jack connector 108 includes a circumferential groove 156 having front and rear shoulders 158. The groove 156 and shoulders 158 define the lock engagement surfaces 154. In an exemplary embodiment, the jack connector 108 extends between a mating end 160 and a cable terminating end 162. The jack connector 108 includes an inner conductor (not shown) and an outer conductor 166.

The plug housing 116 is similar to the jack housing 106, however, wherein the jack housing 106 includes a catch 138, the plug housing 116 includes a latching assembly 168. The latching assembly 168 provides an opening corresponding to the catch 138, and when the jack assembly 102 is mated to the plug assembly 104, the catch 138 is held within the latching assembly 168 to lock the jack housing 106 to the plug housing 116.

The plug housing 116 includes a mating section 170 and a connector retention section 172. A connector cavity 174 extends along the insertion axis 122 through both the mating section 170 and the connector retention section 172. The connector cavity 174 receives the plug connector 118 and the plug housing 116 and plug retention lock 120 cooperate to hold the plug connector 118 in the connector cavity 174. In the illustrated two position connector system 100, the plug assembly 104 includes two connector cavities 174 for holding two plug connectors 118. The mating section 170 mates to the jack housing 106 and may have keying features 176 to assure proper alignment with the jack assembly 102 and/or to verify mating to the correct jack assembly 102. The mating section 170 and the connector retention section 172 include the latching assembly 168 for locking the jack assembly 102 to the plug assembly 104.

The connector retention section 172 includes at least one primary retention feature 180 for locating and holding the plug connector 118 within the connector cavity 174. In an exemplary embodiment, the plug housing 116 includes a primary retention feature 180 for each connector cavity 174. The primary retention features 180 may be the same for each connector cavity 174. The primary retention feature 180 is a curved beam extending from an outer surface 182 of the connector retention section 172 through an opening 184 in the plug housing 116 to a locking end 186 located within the connector cavity 174. The primary retention feature 180 holds the plug connector 118 in an installed position until the plug retention lock 120 is set in the final position. The primary retention feature 180 and the plug retention lock 120 cooperate to hold the plug connector 118 in the plug housing 116.

Each plug connector 118 includes a body 190 having an outer surface 192. In an exemplary embodiment, the plug connectors 118 are identical to one another, however the plug connectors 118 may be different from one another in alternative embodiments. In the illustrated embodiment, the plug connectors 118 are SMB connectors, however other types of connectors may be used in alternative embodiments, and the primary retention features 180 may be different for different types of connectors. The outer surface 192 of the body 190 is generally cylindrical along a central axis that coincides with the insertion axis 122. The outer surface 192 is stepped along the length of the body 190 such that the body 190 does not have a uniform cross section along the length. The outer surface 192 defines at least one lock engagement surface 194 configured to engage the retention lock 120 and/or the primary retention feature 180 as will be described in further detail below. In the illustrated embodiment, the plug connector 118 includes a circumferential groove 196 having front and rear shoulders 198. The groove 196 and shoulders 198 define the lock engagement surfaces 194. In an exemplary embodiment, the plug connector 118 extends between a mating end 200 and a cable terminating end 202. The plug connector 118 includes an inner conductor (not shown) and an outer conductor 206 for mating with the inner and outer conductors of the jack connectors 108.

Figure 3:
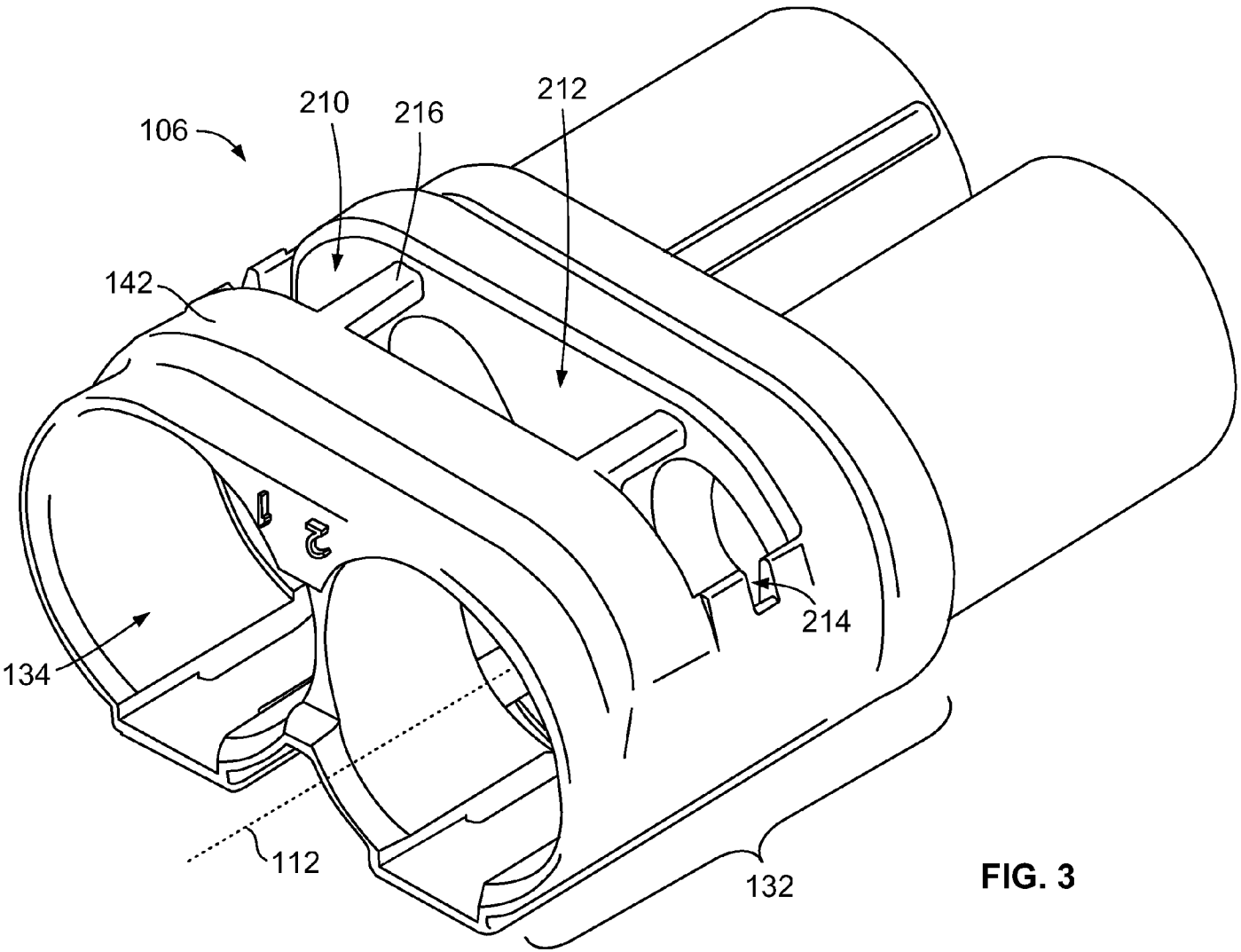
FIG. 3 is a bottom perspective view of a jack housing of the jack assembly shown in FIGS. 1 and 2.

FIG. 3 is a bottom perspective view of a jack housing 106 of the jack assembly 102 (shown in FIGS. 1 and 2). The connector retention section 132 of the jack housing 106 includes a slot 210 in the outer surface 142 opening to a locking chamber 212 defined within the jack housing 106. The locking chamber 212 opens to each of the connector cavities 134. The slot 210 extends across the jack housing 106 perpendicular to the insertion axis 112. In an exemplary embodiment, the slot 210 extends over both connector cavities 134. The slot 210 includes a groove 214 in each end for aligning the jack retention lock 110 (shown in FIG. 1). The jack housing 106 includes at least one rail 216 extending across the slot 210 in the direction of the insertion axis 112. Optionally, each rail 216 may be generally aligned with the center of each connector cavity 134. As will be further described below, the rails 216 assist in the assembly of the jack connectors 108 and/or the jack retention lock 110 into the jack housing 106.

Figure 4:
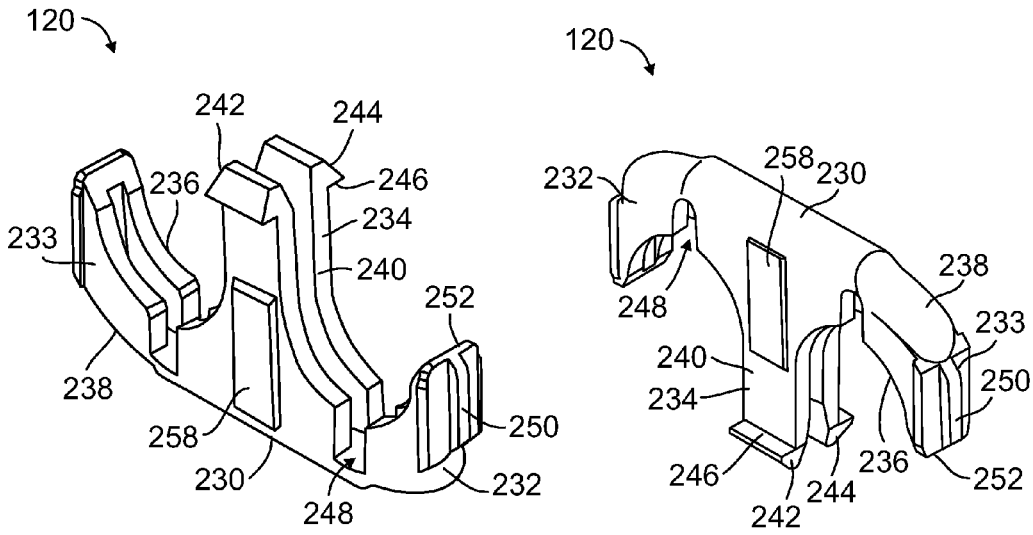
FIG. 4 shows perspective side views of an exemplary embodiment of a retention lock for the plug assembly.

FIG. 4 is a perspective side view of an exemplary embodiment of the retention lock 120 for the plug assembly 104 (shown in FIG. 1). The retention lock 120 has a bottom beam 230, first and second outer legs 232, 233, and a split center post 234. The outer legs 232, 233 have a generally arcuate inner surface 236 and a generally arcuate outer surface 238. The outer surface 238 is shaped to complement the shape of the plug housing 116 (shown in FIG. 1) when coupled thereto. The outer legs 232, 233 and the post 234 cooperate to secure the plug connectors 118 (shown in FIG. 2) within the plug housing 116. The split center post 234 includes two adjacent center beams 240 extending perpendicular to the bottom beam 230 to a top latch 242. The center beams 240 are deflectable toward one another. Each top latch 242 includes an upper ramp surface 244 and a latching surface 246.

The retention lock 120 includes two slots 248 formed in the bottom beam 230. The slots 248 are located between the respective outer legs 232, 233 and the post 234. The slots 248 are located to align with the rails 216 (shown in FIG. 3) of the plug housing 116. The retention lock 120 further includes guide rails 250 on the outer surface 238 of each outer leg 232, 233. The guide rails 250 are positioned proximate to a tip 252 of the respective outer leg 232, 233. The guide rails 250 align with the grooves 214 in the slot 210 of the plug housing 116 to assure proper alignment between the retention lock 120 and the plug housing 116. Optionally, the retention lock 120 may include crush pads 258 along the bottom beam 230 and/or the center beam 240. The crush pads 258 may engage the plug housing 116 to help hold the retention lock 120 within the plug housing 116.

Figure 5:
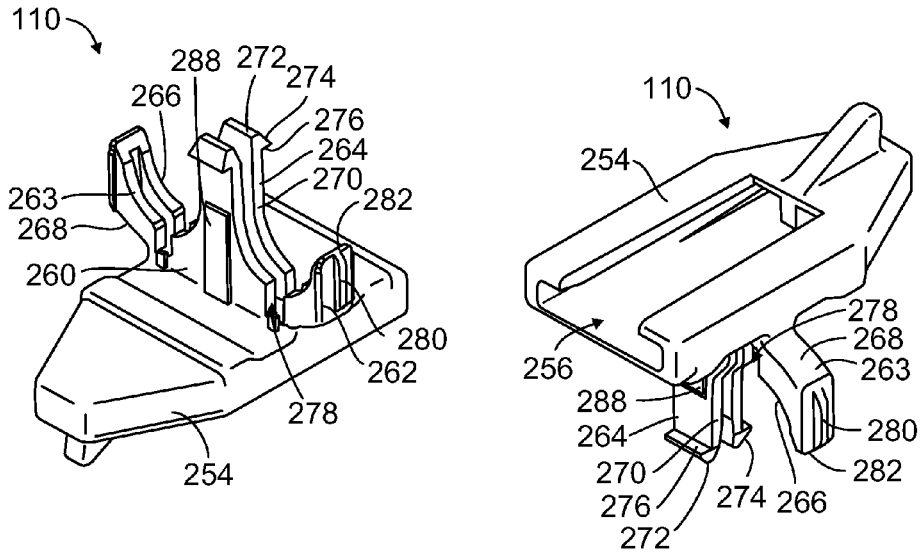
FIG. 5 shows perspective side views of an alternative embodiment of a retention lock for the jack assembly.

FIG. 5 is a perspective side view of the retention lock 110 for the jack assembly 102 (shown in FIG. 1). The retention lock 110 is similar to the retention lock 120 (shown in FIG. 4), however, the retention lock 110 includes a body clip provision 254. The body clip provision 254 includes an opening 256 for mounting to a frame, chassis, bracket, or other Support structure. It is appreciated that either retention lock 110, 120 may be interchangeably used in either of the jack or plug assemblies 102, 104. Even though the retention lock 110 is installed in the jack assembly 102 and the retention lock 120 is installed in plug assembly 104 in the illustrated embodiment, the retention locks 110, 120 may be used interchangeably with either the jack assembly 102 or the plug assembly 104.

The retention lock 110 has a bottom beam 260, first and second outer legs 262, 263, and a split center post 264. The outer legs 262, 263 have a generally arcuate inner surface 266 and a generally arcuate outer surface 268. The outer surface 268 is shaped to complement the shape of the jack housing 106 (shown in FIG. 1) when coupled thereto. The outer legs 262, 263 and the post 264 cooperate to secure the jack connectors 108 (shown in FIG. 1) within the jack housing 106. The split center post 264 includes two adjacent center beams 270 extending perpendicular to the bottom beam 260 to a top latch 272. The center beams 270 are deflectable toward one another. Each top latch 272 includes an upper ramp surface 274 and a latching surface 276.

The retention lock 110 includes two slots 278 formed in the bottom beam 260. The slots 278 are located between the respective outer legs 262, 263 and the post 264. The slots 278 are located to align with rails of the jack housing 106. The retention lock 110 further includes guide rails 280 on the outer surface 268 of each outer leg 262, 263. The guide rails 280 are positioned proximate to a tip 282 of the respective outer leg 262, 263. The guide rails 280 align with the grooves in a slot formed in the jack housing 106 to assure proper alignment between the retention lock 110 and the jack housing 106. Optionally, the retention lock 110 may include crush pads 288 along the bottom beam 260 and/or the center beam 270. The crush pads 288 may engage the jack housing 106 to help hold the retention lock 110 within the jack housing 106.

With reference to FIGS. 1-5, an exemplary assembly operation of the electrical connector system 100 includes assembling the jack assembly 102, assembling the plug assembly 104 and then mating the jack and plug assemblies 102, 104. Assembly of the jack and plug assemblies 102, 104 are similar, and the assembly operation is described with reference to the jack assembly 102.

Figure 7:
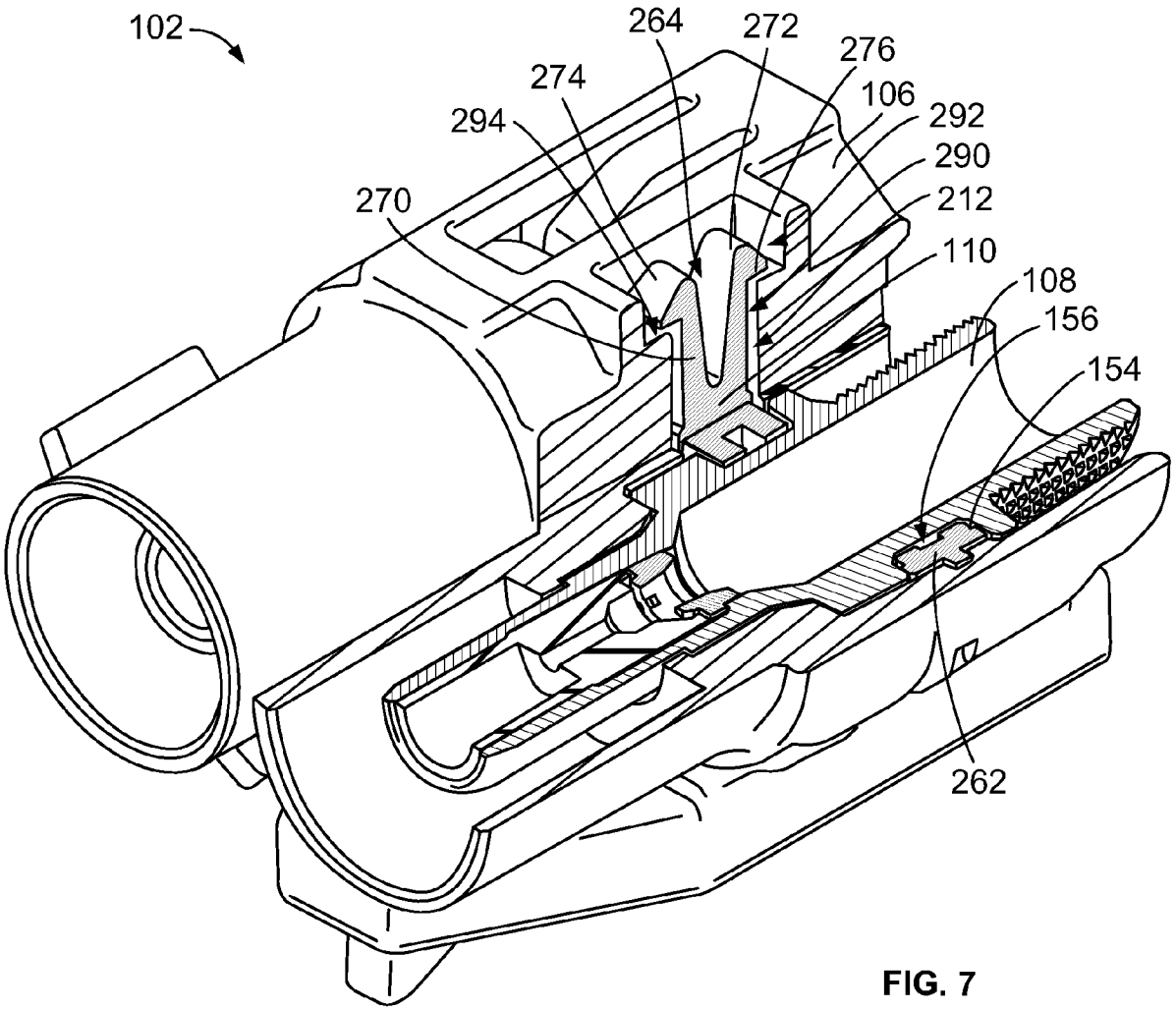
FIG. 7 is another perspective cut-away view of the jack assembly.

The jack connectors 108 are loaded into the connector cavities 134 along the insertion axis 112 through the connector retention section 132 into the mating section 130. In the loaded position, the primary retention features 140 hold the jack connectors 108 within the connector cavities 134. During loading, the jack connectors 108 may have a tendency to hook or fall into the slot 210 of the jack housing 106. The rails 216 are placed across the slots 210 to prevent the jack connector 108 from moving into the slots 210. The rails 216 thus hold the jack connectors 108 generally centered within the connector cavities 134. In an exemplary embodiment, the slots 210 are positioned generally opposite to the primary retention features 140. Once the jack connectors 108 are loaded into the jack housing 106, the retention lock 110 is loaded into the jack housing 106. The retention lock 110 is loaded into the jack housing 106 through the slot 210 into the locking chamber 212 as described in further detail below and as illustrated in FIG. 7. The top latches 272 secure the retention lock 110 in the locking chamber 212. When loaded, the retention lock 110 engages the lock engagement surfaces 154. In the illustrated embodiment, the retention lock 110 fits in the groove 156 to lock the jack connectors 108 in the connector cavities 134. When the retention lock 110 is inserted into the slot 210, the guide rails 280 on the outer legs 262, 263 slide within the grooves 214 of the jack housing 106.

Figure 6:
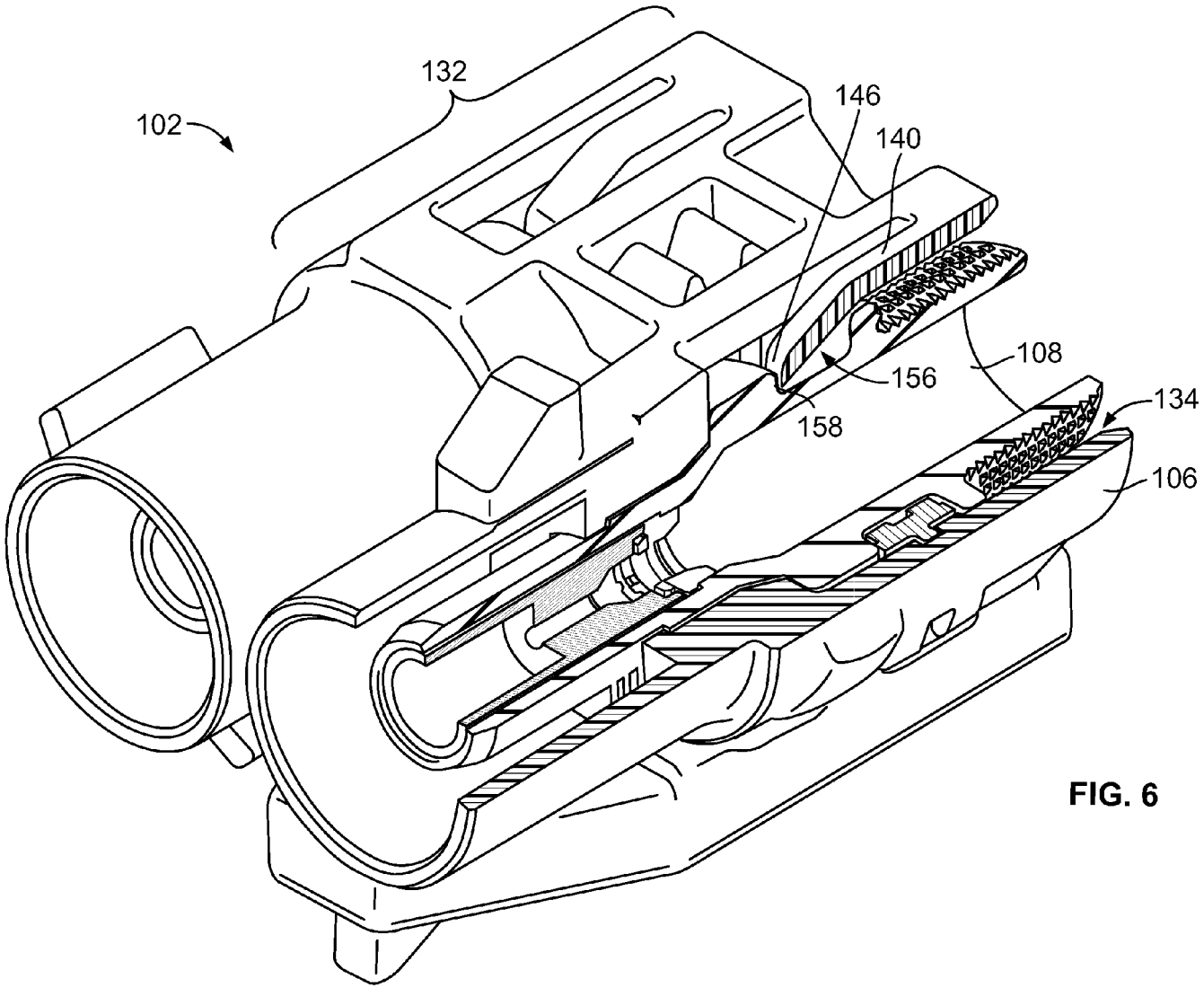
FIG. 6 is a perspective cut-away view of the jack assembly.

FIG. 6 is a perspective cut-away view of the jack assembly 102 in an assembled state. The jack connectors 108 are loaded into the connector cavities 134. FIG. 6 illustrates the connector retention section 132 supporting the jack connector 108, wherein the surfaces of the jack connector 108 and the connector retention section 132 are complementary in shape such that the jack connector 108 is properly positioned in the jack housing 106. FIG. 6 also illustrates the primary retention feature 140 engaging the jack connector 108. In an exemplary embodiment, the locking end 146 of the primary retention feature 140 is located within the connector cavity 134 and extends into the circumferential groove 156 to engage the front shoulder 158.

FIG. 7 is another perspective cut-away view of the jack assembly 102 in an assembled state illustrating the retention lock 110 positioned in the locking chamber 212. When assembled, the retention lock 110 engages the lock engagement surfaces 154 of the jack connector 108. In an exemplary embodiment, the outer leg 262 of the retention lock 110 is located in the groove 156 along an outer portion of the jack connector 108, and the post 264 of the retention lock 110 is located in the groove 156 along an inner portion of the jack connector 108. A portion of the post 264 is illustrated in FIG. 7 as being cut-away.

The locking chamber 212 of the jack housing 106 includes a central opening generally in the center of the jack housing 106 having a first section 290 and a wider second section 292. The second section 292 is open along the top of the jack housing 106 such that the top latch 272 is accessible from the exterior of the jack housing 106, such as to release the top latch 272 to remove the retention lock 110 from the jack housing 106. A ledge 294 is located where the first section 290 meets the second section 292. As the retention lock 110 is inserted into jack housing 106, the center beams 270 of the split center post 264 are biased towards each other as the ramp surfaces 274 are inserted through the first section 290 of the central opening of the jack housing 106. As the top latch 272 moves into the second section 292 of the central opening, the beams 270 of the split center post 264 are released and the latching surfaces 276 rest on the ledge 294 thereby locking the retention lock 110 within the jack housing 106.

Figure 8:
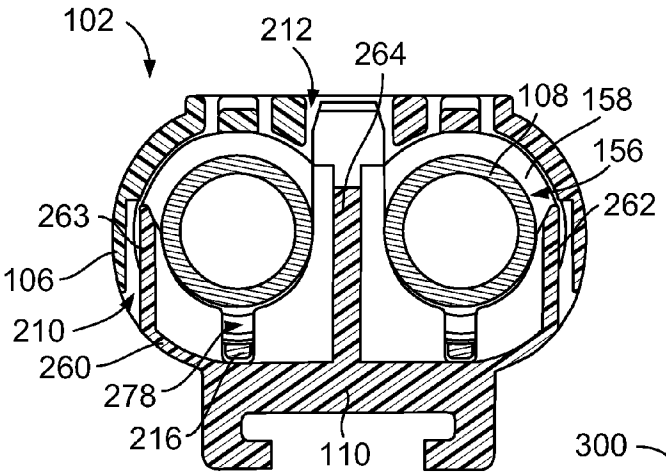
FIG. 8 is a cross-sectional view of the jack assembly taken through a portion of the retention lock.

FIG. 8 is a cross-sectional view of the jack assembly 102 taken through a portion of the retention lock 110. The retention lock 110 is loaded into the locking chamber 212 through the slot 210 in the jack housing 106. FIG. 8 illustrates the rails 216 that span the slot 210 being at least partially received in the slots 278 in the bottom beam 260 of the retention lock 110. In the illustrated embodiment, the slots 278 are substantially centered between the respective outer legs 262, 263 and the post 264, however, the slots 278 may be positioned closer to the post 264 or closer to the respective outer leg 262, 263 in alternative embodiments.

FIG. 8 illustrates the rear shoulder 158 of the jack connector 108 with the retention lock 110 received in the groove 156. The outer leg 262 of the retention lock 110 is located in the groove 156 along an outer portion of the jack connector 108, and the post 264 of the retention lock 110 is located in the groove 156 along an inner portion of the jack connector 108. In an exemplary embodiment, the outer leg 262 and the post 264 cooperate to circumferentially engage the lock engagement surface 154 around approximately half of the body 150.

Figure 9:
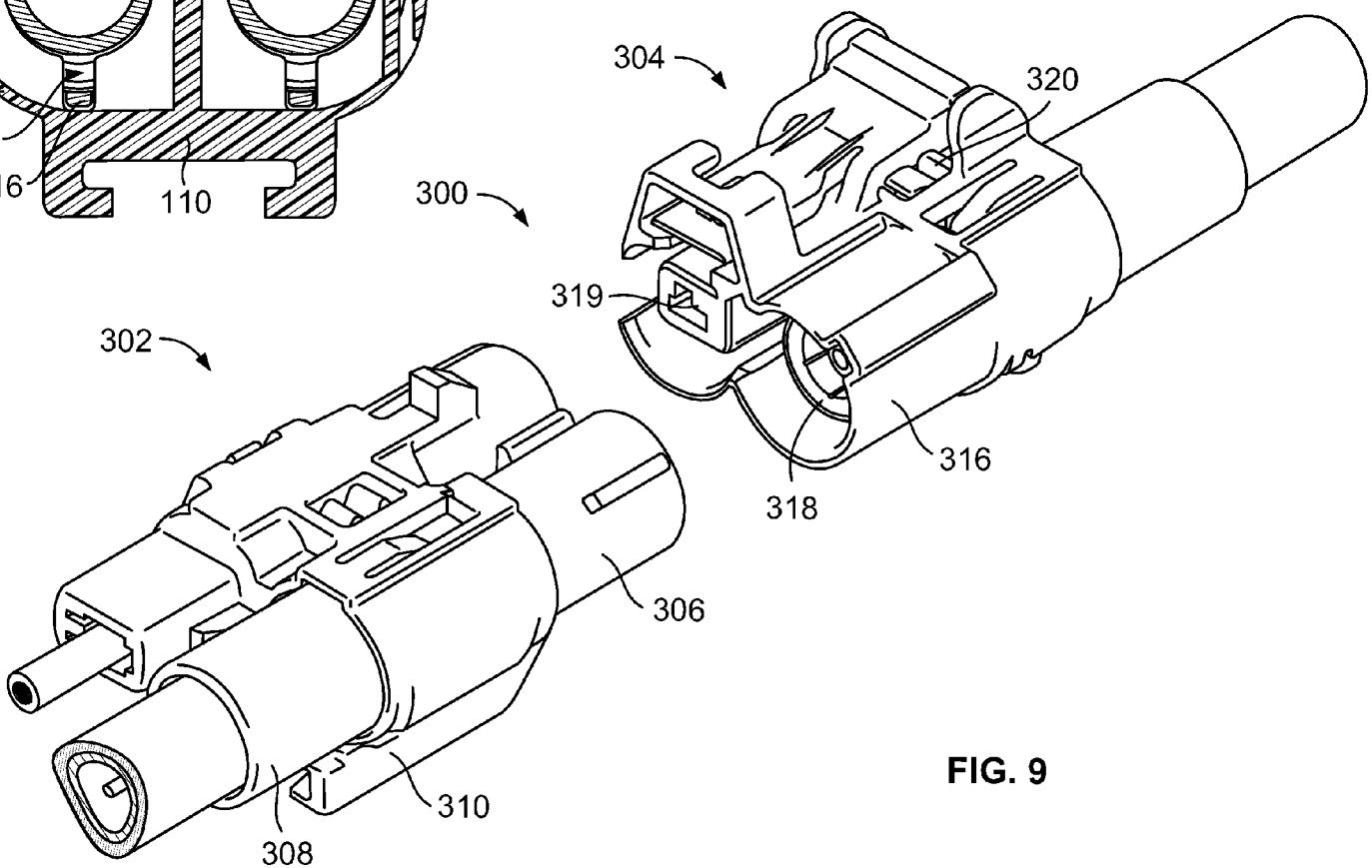
FIG. 9 is a perspective view of an alternative electrical connector system illustrating an alternative jack assembly and an alternative plug assembly.

FIG. 9 is a perspective view of an alternative electrical connector system 300 illustrating an alternative jack assembly 302 and an alternative plug assembly 304. The jack and plug assemblies 302, 304 are mated together to form an electrical connection therebetween. The jack assembly 302 includes a jack housing 306 and jack connectors 308, 309 (shown in FIG. 10) received in the jack housing 306. The jack connectors 308, 309 may be cable mounted or terminated to an end of a wire. A jack retention lock 310 is used to secure the jack connectors 308, 309 in the jack housing 306. The plug assembly 304 includes a plug housing 316 and a plurality of plug connectors 318, 319 (shown in FIG. 12) received in the plug housing 316. The plug connectors 318, 319 may be cable mounted or terminated to an end of a wire. A plug retention lock 320 is used to secure the plug connectors 318, 319 in the plug housing 316.

The connector system 300 is similar to the connector system 100, shown in FIG. 1, except that the jack and plug assemblies 302, 304 have two different types of jack connectors 308, 309 and plug connectors 318, 319, respectively. Optionally, one of the jack connectors 308 and one of the plug connectors 318 are substantially similar to the jack and plug connectors 108, 118 (shown in FIG. 2). However, the other jack connector 309 and the other plug connector 319 are different than the jack and plug connectors 108, 118. In the illustrated embodiment, the jack and plug connectors 309, 319 represent wire terminal type connectors as opposed to SMB type connectors. Consequently, even though the retention locks 310 and 320 operate similarly to retention locks 110, 120 (shown in FIG. 1), the configuration of the jack and plug housings 306, 316 differ from the jack and plug housings 106, 116 (shown in FIG. 1) and the configuration of retention locks 310, 320 differ from the configuration of retention locks 110, 120.

Figure 10:
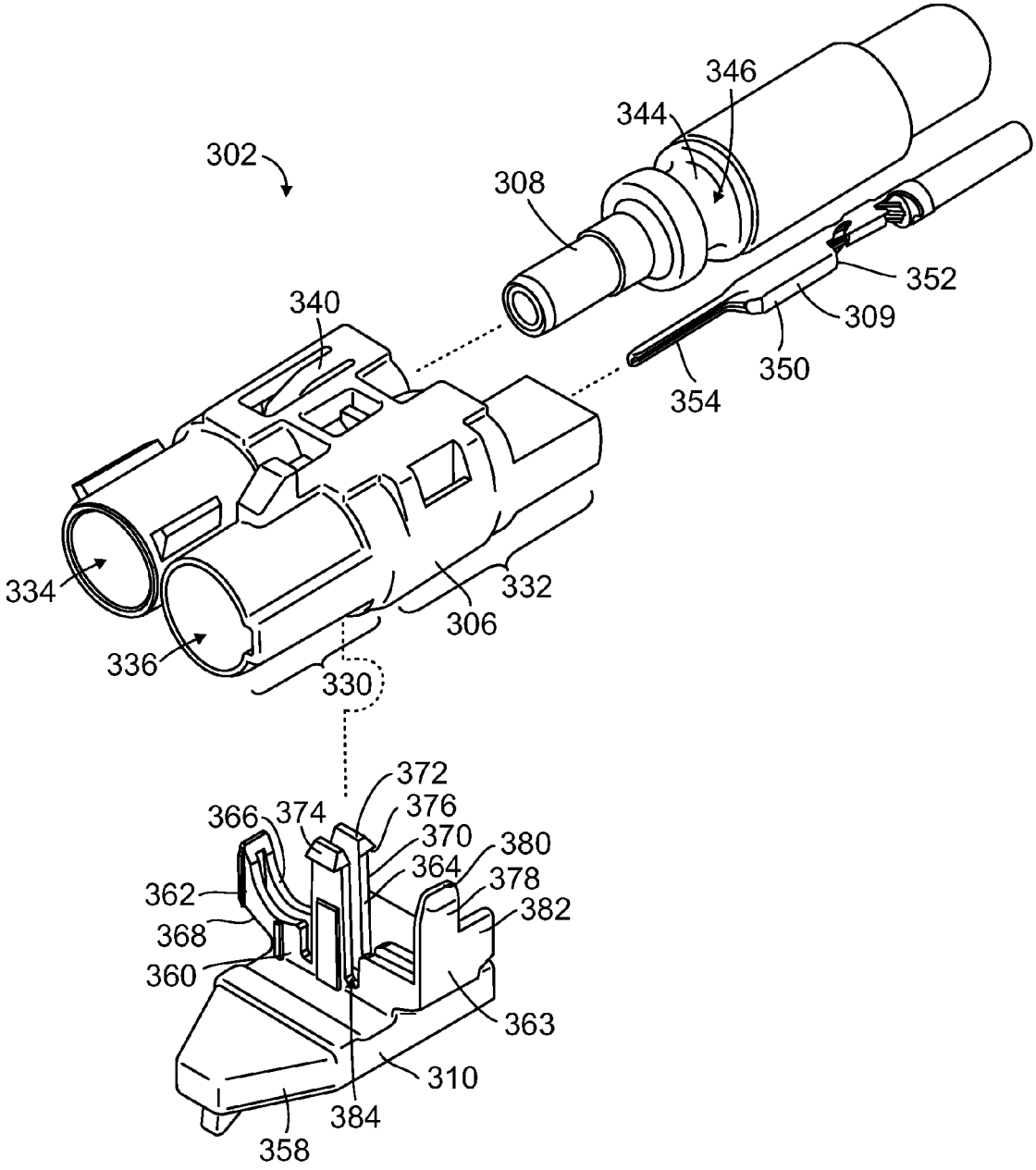
FIG. 10 is an exploded perspective view of the jack assembly shown in FIG. 9.

FIG. 10 is an exploded perspective view of the jack assembly 302. The jack housing 306 includes a mating section 330 and a connector retention section 332. First and second connector cavities 334, 336 extend through the mating section 330 and the connector retention section 332. The connector cavities 334, 336 receive the jack connectors 308, 309, respectively. The jack housing 306 and jack retention lock 310 cooperate to hold the jack connectors 308, 309 in the connector cavities 334, 336. In an exemplary embodiment, the connector cavities 334, 336 are generally aligned along a common centerline such that the jack connectors 308, 309 are aligned with one another.

In an exemplary embodiment, the connector retention section 332 includes a primary retention feature 340, which may be similar to the primary retention feature 140 (shown in FIG. 2), extending into the first connector cavity 334 for locating and holding the jack connector 308 within the connector cavity 334. As will be described in further detail below, a different type of primary retention feature, represented by a primary latch 342 (shown in FIG. 11), extends into the second connector cavity 336 for locating and holding the jack connector 309. The primary retention features 340, 342 hold the jack connectors 308, 309 in an installed position and cooperate with the jack retention lock 310 to lock the jack connectors 308, 309 within the respective connector cavities 334, 336.

In the illustrated embodiment, the first jack connector 308 is represented by an SMB type connector. The first jack connector 308 includes a lock engagement surface 344 configured to engage the retention lock 310 and/or the primary retention feature 340. The first jack connector 308 includes a circumferential groove 346. The second jack connector 309 is represented by a jack wire terminal type connector. The second jack connector 309 is terminated to the end of a wire, such as by a crimp connection. The jack connector 309 includes a connector body 350 having a lock engagement surface 352 proximate a rear end thereof. The jack connector 309 includes a pin 354 extending from a front of the body 350. The pin 354 is configured to mate with the plug connector 319 (shown in FIG. 12).

The retention lock 310 is a body clip type or retention lock, that includes a body clip provision 358 on a bottom beam 360. The retention lock 310 also includes first and second outer legs 362, 363, and a split center post 364. The first outer leg 362 has a generally arcuate inner surface 366 and a generally arcuate outer surface 368. The outer surface 368 is shaped to complement the shape of the jack housing 306 when coupled thereto. The first outer leg 362 and the post 364 cooperate to secure the jack connector 308 within the jack housing 306. The split center post 364 includes two adjacent center beams 370 extending perpendicular to the bottom beam 360 to a top latch 372. The center beams 370 are deflectable toward one another. Each top latch 372 includes an upper ramp surface 374 and a latching surface 376.

The second outer leg 363 includes a latch leg 378 having a top latch 380 and a lock beam 382 adjacent the second outer leg 363 extending perpendicular to the bottom beam 360. The second outer leg 363 is generally planar and extends perpendicularly from the bottom beam 360. In an exemplary embodiment, the second outer leg 363 is generally parallel to the post 364.

The retention lock 310 includes two slots 384 formed in the bottom beam 360. The slots 384 are located between the respective outer legs 362, 363 and the post 364. In the illustrated embodiment, the slots 384 are located adjacent the post 364. The slots 384 are located to align with rails of the jack housing 306. The rails are similar to the rails 216 of the jack housing 106 (shown in FIG. 3).

Figure 11:
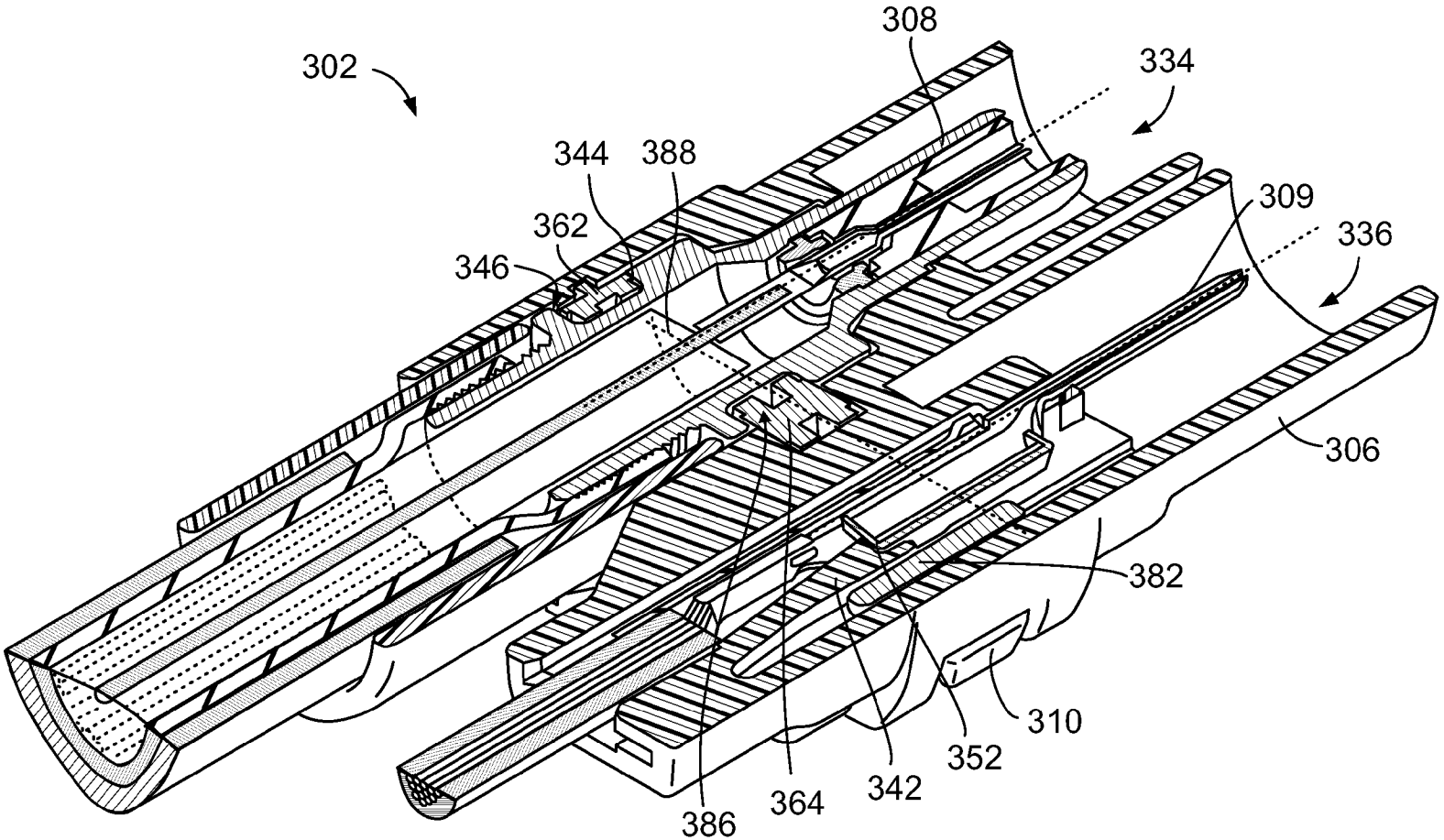
FIG. 11 is a perspective cut-away view of the jack assembly shown in FIG. 9.

FIG. 11 is a perspective cut-away view of the jack assembly 302 illustrating the jack connectors 308, 309 loaded into the connector cavities 334, 336 in the jack housing 306. The retention lock 310 is also illustrated in a loaded position within a locking chamber 386 of the jack housing 306. The post 364 of the retention lock 310 is positioned between the two jack connectors 308, 309. In an exemplary embodiment, the post 364 intersects an axis bi-sector 388 extending between the two jack connectors 308, 309.

When assembled, the retention lock 310 engages the lock engagement surface 344 of the jack connector 308. In an exemplary embodiment, the first outer leg 362 of the retention lock 310 is located in the groove 346 along an outer portion of the jack connector 308, and the post 364 of the retention lock 310 is located in the groove 346 along an inner portion of the jack connector 308. The retention lock 310 thus retains the jack connector 308 in the jack housing 306. In an exemplary embodiment, the first outer leg 362 operates as a secondary locking feature to supplement the primary retention feature 340 (shown in FIG. 10) of the jack housing 306.

FIG. 11 also illustrates the primary retention feature 342 (e.g. the primary latch 342) engaging the lock engagement surface 352 to lock the second jack connector 309 within the second connector cavity 336. A portion of the primary latch 342 is positioned between the second outer leg 363 (shown in FIG. 10) and the second jack connector 309. The second outer leg 363 of the retention lock 310 backs up the primary latch 342 to hold the primary latch 342 in a locking position. Optionally, the lock beam 382 is aligned with the primary latch 342 to block unlatching of the primary latch 342. The second outer leg 363 thus operates as a secondary locking feature.

Figure 12:
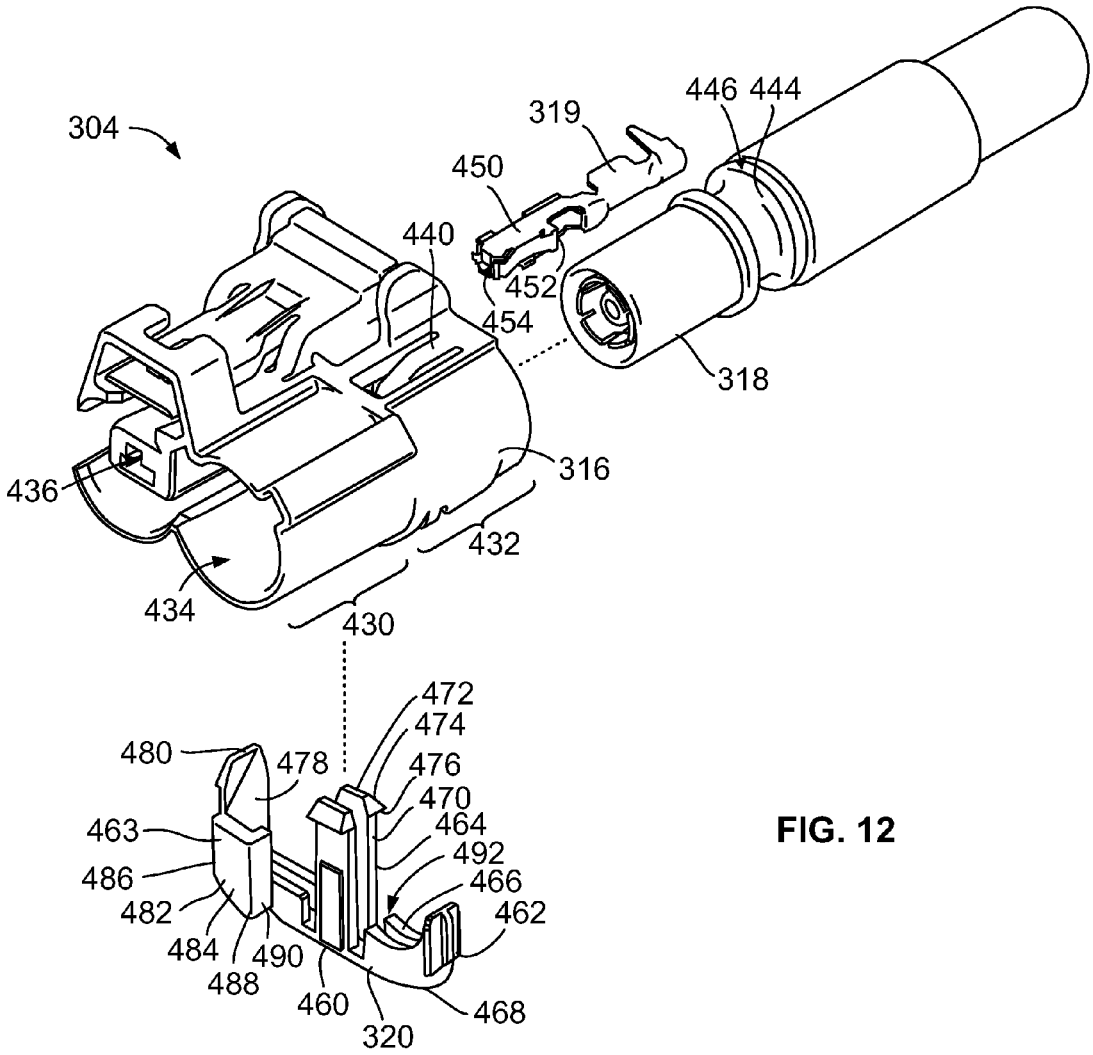
FIG. 12 is an exploded perspective view of the plug assembly shown in FIG. 9.

FIG. 12 is an exploded perspective view of the plug assembly 304. The plug housing 316 includes a mating section 430 and a connector retention section 432. First and second connector cavities 434, 436 extend through the mating section 430 and the connector retention section 432. The connector cavities 434, 436 receive the plug connectors 318, 319, respectively. The plug housing 316 and plug retention lock 320 cooperate to hold the plug connectors 318, 319 in the connector cavities 434, 436. In an exemplary embodiment, the connector cavities 434, 436 are generally aligned along a common centerline such that the plug connectors 318, 319 are aligned with one another.

In an exemplary embodiment, the connector retention section 432 includes a primary retention feature 440 extending into the first connector cavity 434 for locating and holding the plug connector 318 within the connector cavity 434. As will be described in further detail below, a different type of primary retention feature, represented by a primary latch 442 (shown in FIG. 13), extends into the second connector cavity 436 for locating and holding the plug connector 319. The primary retention features 440, 442 hold the plug connectors 318, 319 in an installed position and cooperate with the plug retention lock 320 to lock the plug connectors 318, 319 within the respective connector cavities 434, 436.

In the illustrated embodiment, the first plug connector 318 is represented by an SMB type connector. The first plug connector 318 includes a lock engagement surface 444 configured to engage the retention lock 320 and/or the primary retention feature 440. The first plug connector 318 includes a circumferential groove 446. The second plug connector 319 is represented by a plug wire terminal type connector. The second plug connector 319 is terminated to the end of a wire, such as by a crimp connection. The plug connector 319 includes a connector body 450 having a lock engagement surface 452 proximate a rear end thereof. The plug connector 319 includes a socket 454 at a front of the body 450. The socket 454 is configured to mate with the jack connector 309 (shown in FIG. 10).

The retention lock 320 includes a bottom beam 460, first and second outer legs 462, 463, and a split center post 464. The first outer leg 462 has a generally arcuate inner surface 466 and a generally arcuate outer surface 468. The outer surface 468 is shaped to complement the shape of the plug housing 316 when coupled thereto. The first outer leg 462 and the post 464 cooperate to secure the plug connector 318 within the plug housing 316. The split center post 464 includes two adjacent center beams 470 extending perpendicular to the bottom beam 460 to a top latch 472. The center beams 470 are deflectable toward one another. Each top latch 472 includes an upper ramp surface 474 and a latching surface 476.

The second outer leg 463 includes a latch leg 478 having a top latch 480 and a lock beam 482 having a first section 484 adjacent the bottom beam 460 extending from a first end 486 at the latch leg 478 parallel the bottom beam 460 to a second end 488, and a second section 490 extending from the second end 488 towards the bottom beam 460.

The retention lock 320 includes two slots 492 formed in the bottom beam 460. The slots 492 are located between the respective outer legs 462, 463 and the post 464. In the illustrated embodiment, the slots 492 are located adjacent the post 464. The slots 492 are located to align with rails of the plug housing 316. The rails are similar to the rails 216 of the jack housing 106 (shown in FIG. 4).

Figure 13:
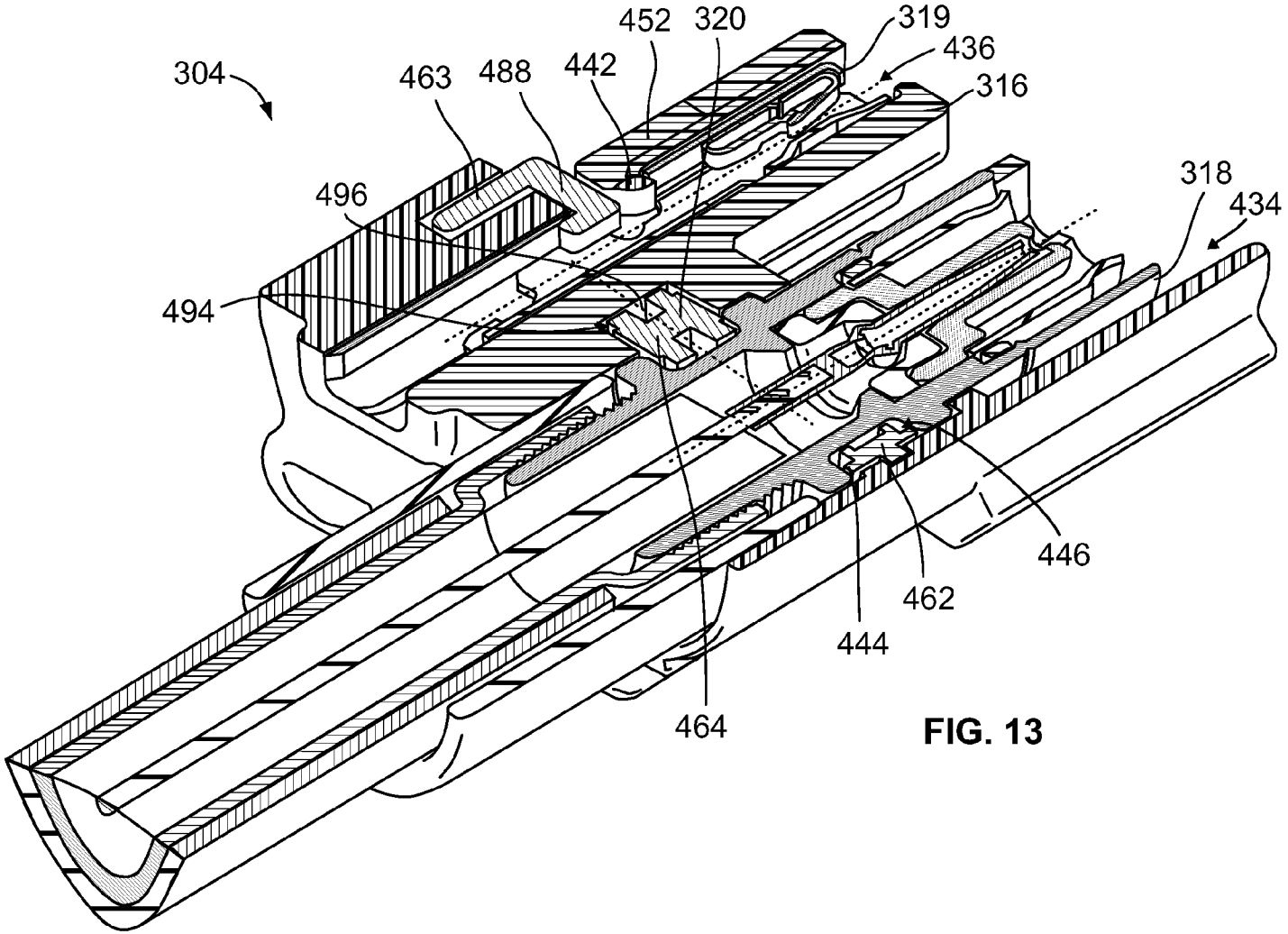
FIG. 13 is a perspective cut-away view of the plug assembly shown in FIG. 9.

FIG. 13 is a perspective cut-away view of the plug assembly 304 illustrating the plug connectors 318, 319 loaded into the connector cavities 434, 436 in the plug housing 316. The retention lock 320 is also illustrated in a loaded position within a locking chamber 494 of the plug housing 316. The post 464 of the retention lock 320 is positioned between the two plug connectors 318, 319. In an exemplary embodiment, the post 464 intersects an axis bi-sector 496 extending between the two plug connectors 318, 319.

When assembled, the retention lock 320 engages the lock engagement surface 444 of the plug connector 318. In an exemplary embodiment, the first outer leg 462 of the retention lock 320 is located in the groove 446 along an outer portion of the plug connector 318, and the post 464 of the retention lock 320 is located in the groove 446 along an inner portion of the plug connector 318. The retention lock 320 thus retains the plug connector 318 in the plug housing 316. In an exemplary embodiment, the first outer leg 462 operates as a secondary locking feature to supplement the primary retention feature 440 (shown in FIG. 10) of the plug housing 316.

FIG. 13 also illustrates the primary retention feature 442 (e.g. the primary latch 442) engaging the lock engagement surface 452 to lock the second plug connector 319 within the second connector cavity 436. A portion of the primary latch 442 is positioned between the lock beam 488 of the second outer leg 463 and the second plug connector 319. The lock beam 488 of the retention lock 320 backs up the primary latch 442 to hold the primary latch 442 in a locking position. The second outer leg 463 thus operates as a secondary locking feature. As the retention lock 320 is installed within the plug housing 316, the second section 496 of the second outer leg 463 locks against a surface of the plug wire terminal connector 319 to prevent the accidental removal of the plug wire terminal connector 319.

Figure 14:
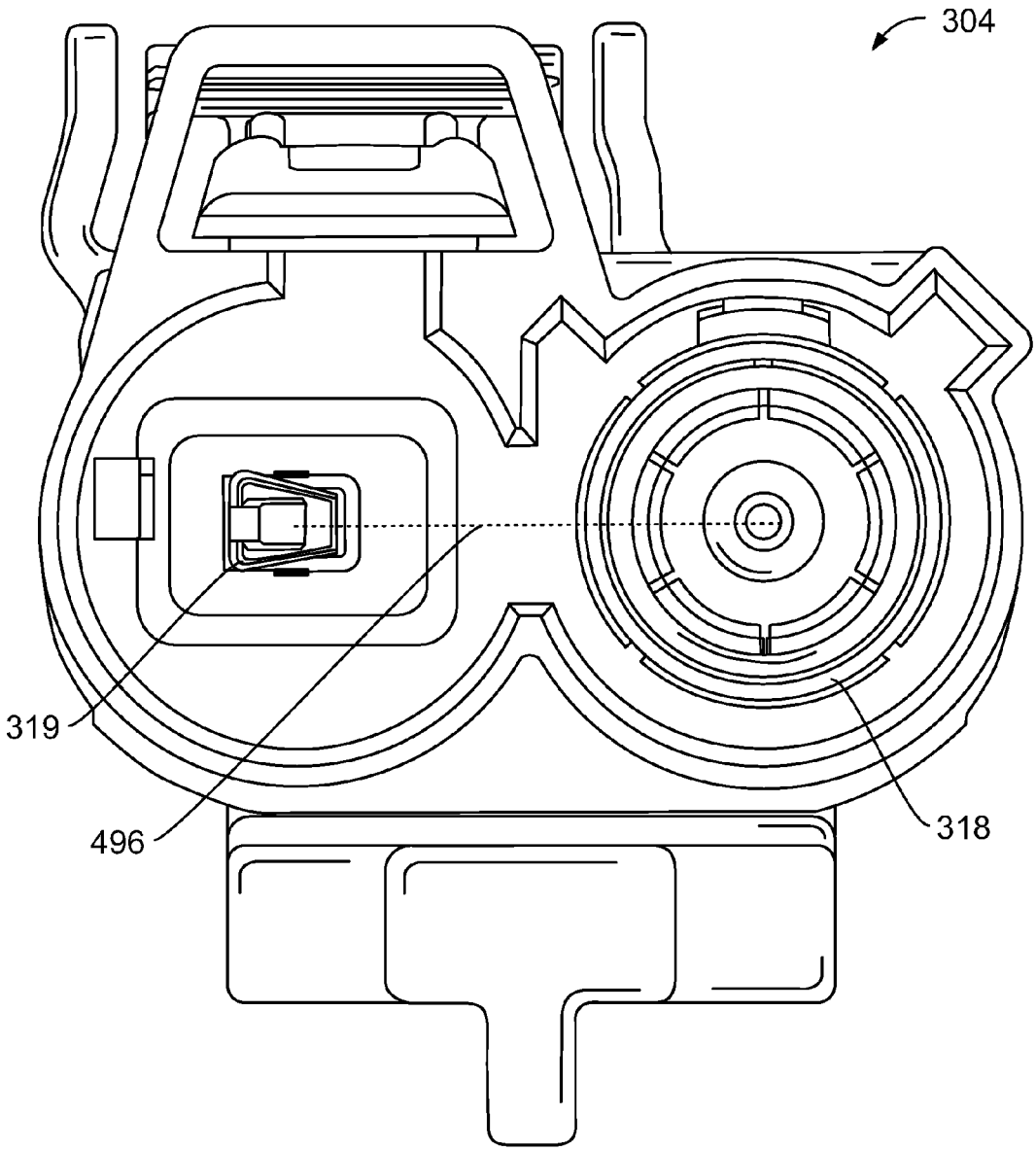
FIG. 14 is a front view of the plug assembly shown in FIG. 9.

FIG. 14 is a front view of the plug assembly 304 illustrating a mating interface of the plug assembly 304. In an exemplary embodiment, a connector centerline of each of the plug connectors 318, 319 are aligned with one another. The axis bisector 496 extends between the connector centerlines. In an exemplary embodiment, the outer perimeter of the plug assembly 304 is substantially similar to the outer perimeter of the plug assembly 104 (shown in FIG. 1). As such, the tooling for manufacturing both assemblies 104, 304 may be similar. Additionally, the mounting of the assemblies 104, 304 may be similar. For example, the assemblies 104, 304 may be mounted within an opening in a panel, and both assemblies 104, 304 are configured to fit within the same panel opening.

Figure 15:
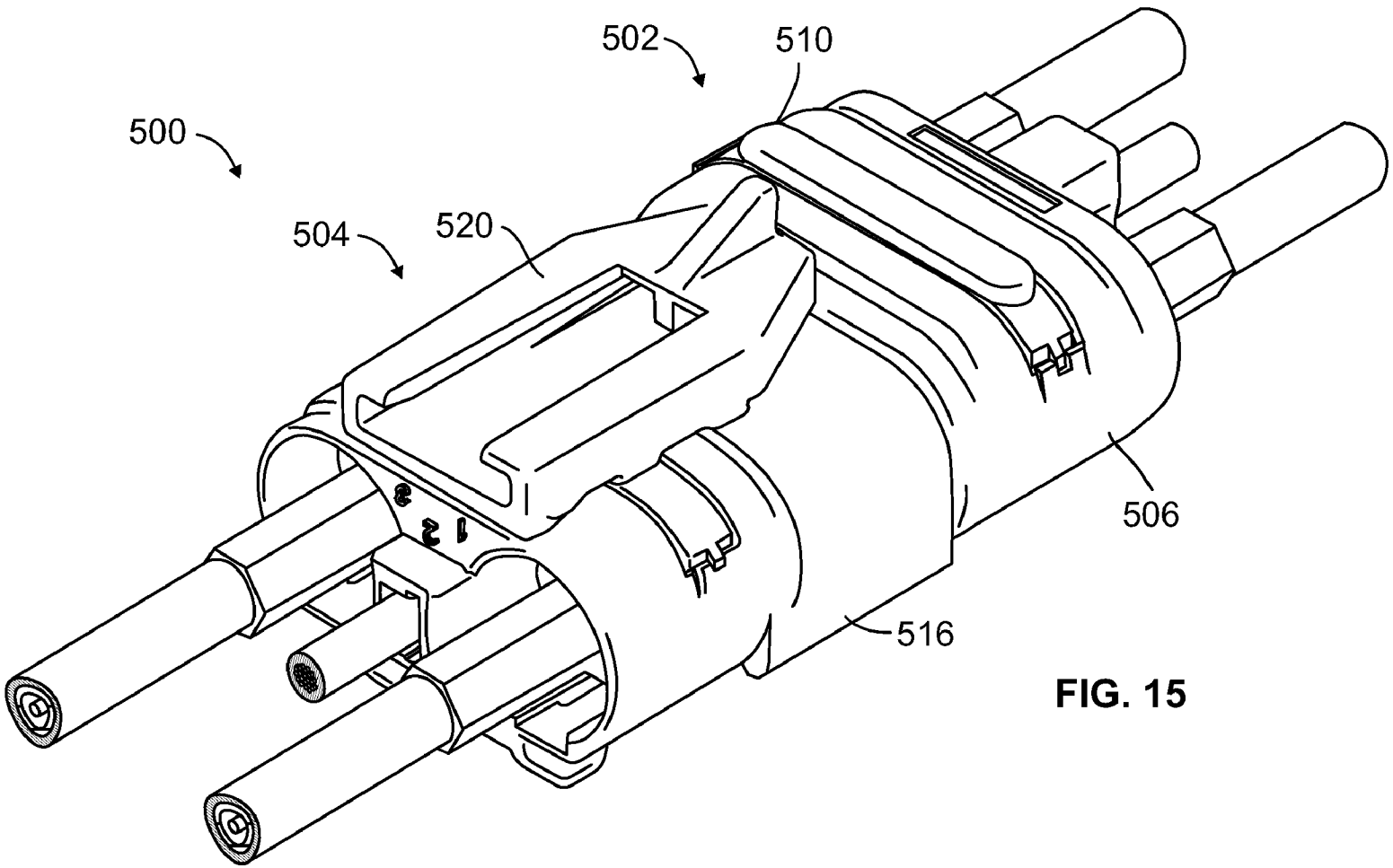
FIG. 15 is an assembled bottom perspective view of another alternative electrical connector system illustrating an alternative jack assembly and an alternative plug assembly.

FIG. 15 is an assembled bottom perspective view of another alternative electrical connector system 500 illustrating an alternative jack assembly 502 and an alternative plug assembly 504. The jack and plug assemblies 502, 504 are mated together to form an electrical connection therebetween. The jack assembly 502 includes a jack housing 506 and jack connectors 507, 508, 509 (shown in FIG. 16) received in the jack housing 506. The jack connectors 507, 508, 509 may be cable mounted or terminated to an end of a wire. A jack retention lock 510 is used to secure the jack connectors 507, 508, 509 in the jack housing 506. The plug assembly 504 includes a plug housing 516 and a plurality of plug connectors 517, 518, 519 (shown in FIG. 18) received in the plug housing 516. The plug connectors 517, 518, 519 may be cable mounted or terminated to an end of a wire. A plug retention lock 520 is used to secure the plug connectors 517, 518, 519 in the plug housing 516.

The connector system 500 is similar to the connector system 300, shown in FIG. 9, except that the jack and plug assemblies 502, 504 have three jack connectors 507, 508, 509 and three plug connectors 517, 518, 519, respectively. In an exemplary embodiment, the jack assembly 502 includes two SMB type connectors as the outer connectors and a single wire terminal type connector. Similarly, the plug assembly 504 includes two SMB type connectors as the outer connectors and a single wire terminal type connector. Consequently, even though the retention locks 510 and 520 operate similarly to the retention locks 310, 320 (shown in FIG. 9), the configuration of the jack and plug housings 506, 516 differ from the jack and plug housings 306, 316 (shown in FIG. 9) and the configuration of retention locks 510, 520 differ from the configuration of retention locks 310, 320.

Figure 16:
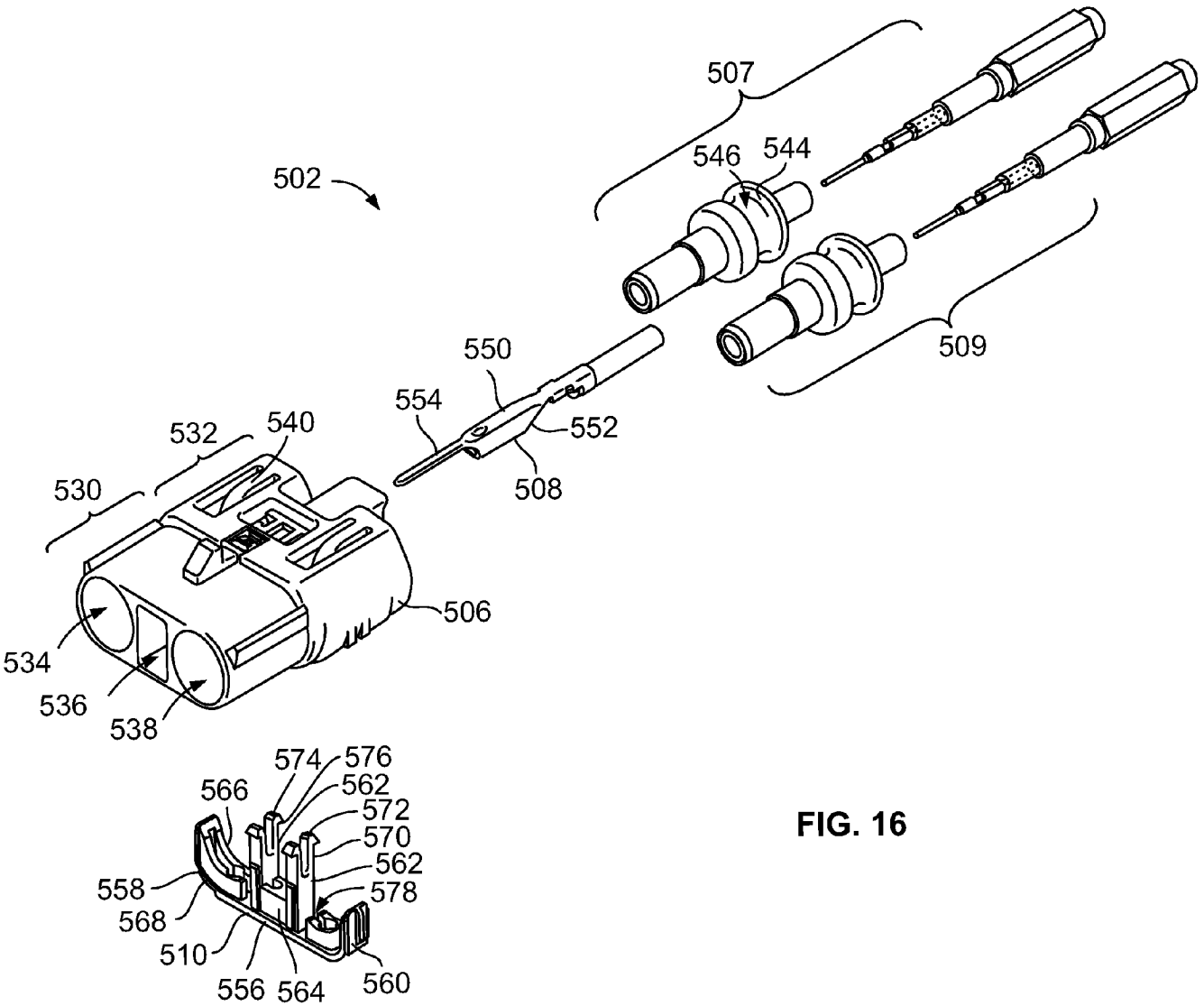
FIG. 16 is an exploded perspective view of the jack assembly shown in FIG. 15.

FIG. 16 is an exploded perspective view of the jack assembly 502. The jack housing 506 includes a mating section 530 and a connector retention section 532. First, second and third connector cavities 534, 536, 538 extend through the mating section 530 and the connector retention section 532. The connector cavities 534, 536, 538 receive the jack connectors 507, 508, 509, respectively. The jack housing 506 and jack retention lock 510 cooperate to hold the jack connectors 507, 508, 509 in the connector cavities 534, 536, 538. In an exemplary embodiment, the connector cavities 534, 536, 538 are generally aligned along a common centerline such that the jack connectors 507, 508, 509 are aligned with one another. In an exemplary embodiment, the first and third connector cavities 534, 538 are substantially identical to one another and positioned on both sides of the second connector cavity 536, which is different than the first and third connector cavities 534, 538.

In an exemplary embodiment, the connector retention section 532 includes primary retention features 540 extending into the first and third connector cavities 534, 538 for locating and holding the first and third jack connectors 507, 509 within the connector cavities 534, 538, respectively. In the illustrated embodiment, the first and third jack connectors 507, 509 define outer jack connectors which are positioned closer to the outer edges of the housing 506. As will be described in further detail below, a different type of primary retention feature, represented by a primary latch 542 (shown in FIG. 17), extends into the second connector cavity 536 for locating and holding the second jack connector 508. The second jack connector 508 defines a middle jack connector that is positioned generally between the outer jack connectors 507, 509, where the middle jack connector 508 may be offset either toward the top or bottom with respect to the outer jack connectors 507, 509. The middle jack connector 508 does not necessarily need to be centered between the outer edges of the housing 506. The primary retention features 540, 542 hold the jack connectors 507, 508, 509 in an installed position and cooperate with the jack retention lock 510 to lock the jack connectors 507, 508, 509 within the respective connector cavities 534, 536, 538.

In the illustrated embodiment, the first and third jack connectors 507, 509 are represented by SMB type connectors. Optionally, the first and third jack connectors 507, 509 are substantially identical to one another. The discussion below focuses on the first jack connector 507, but it is realized that the third jack connector 509 includes similar features. The first jack connector 507 includes a lock engagement surface 544 configured to engage the retention lock 510 and/or the primary retention feature 540. The first jack connector 507 includes a circumferential groove 546.

The second jack connector 508 is represented by a jack wire terminal type connector. The second jack connector 508 is terminated to the end of a wire, such as by a crimp connection. The jack connector 508 includes a connector body 550 having a lock engagement surface 552 proximate a rear end thereof. The jack connector 508 includes a pin 554 extending from a front of the body 550. The pin 554 is configured to mate with the plug connector 518 (shown in FIG. 18).

The retention lock 510 includes a bottom beam 556, first and second outer legs 558, 560, a pair of split center posts 562, and a center leg 564 extending between the center posts 562. The outer legs 558, 560 have a generally arcuate inner surface 566 and a generally arcuate outer surface 568. The outer surfaces 568 and the bottom beam 556 are shaped to complement the shape of the jack housing 506 when coupled thereto. The first outer leg 558 and one of the posts 562 cooperate to secure the first jack connector 507 within the jack housing 506. The second outer leg 560 and the other post 562 cooperate to secure the third jack connector 509 within the jack housing 506. The center leg 564 extends parallel to the bottom beam 556. The split center posts 562 each include two adjacent center beams 570 extending perpendicular to the bottom beam 556 to a top latch 572. The center beams 570 are deflectable toward one another. Each top latch 572 includes an upper ramp surface 574 and a latching surface 576.

The retention lock 510 includes two slots 578 formed in the bottom beam 556. The slots 578 are located between the respective outer legs 558, 560 and the posts 562. In the illustrated embodiment, the slots 578 are located adjacent to the posts 562. The slots 578 are located to align with rails of the jack housing 506. The rails are similar to the rails 216 of the jack housing 106 (shown in FIG. 5).

Figure 17:
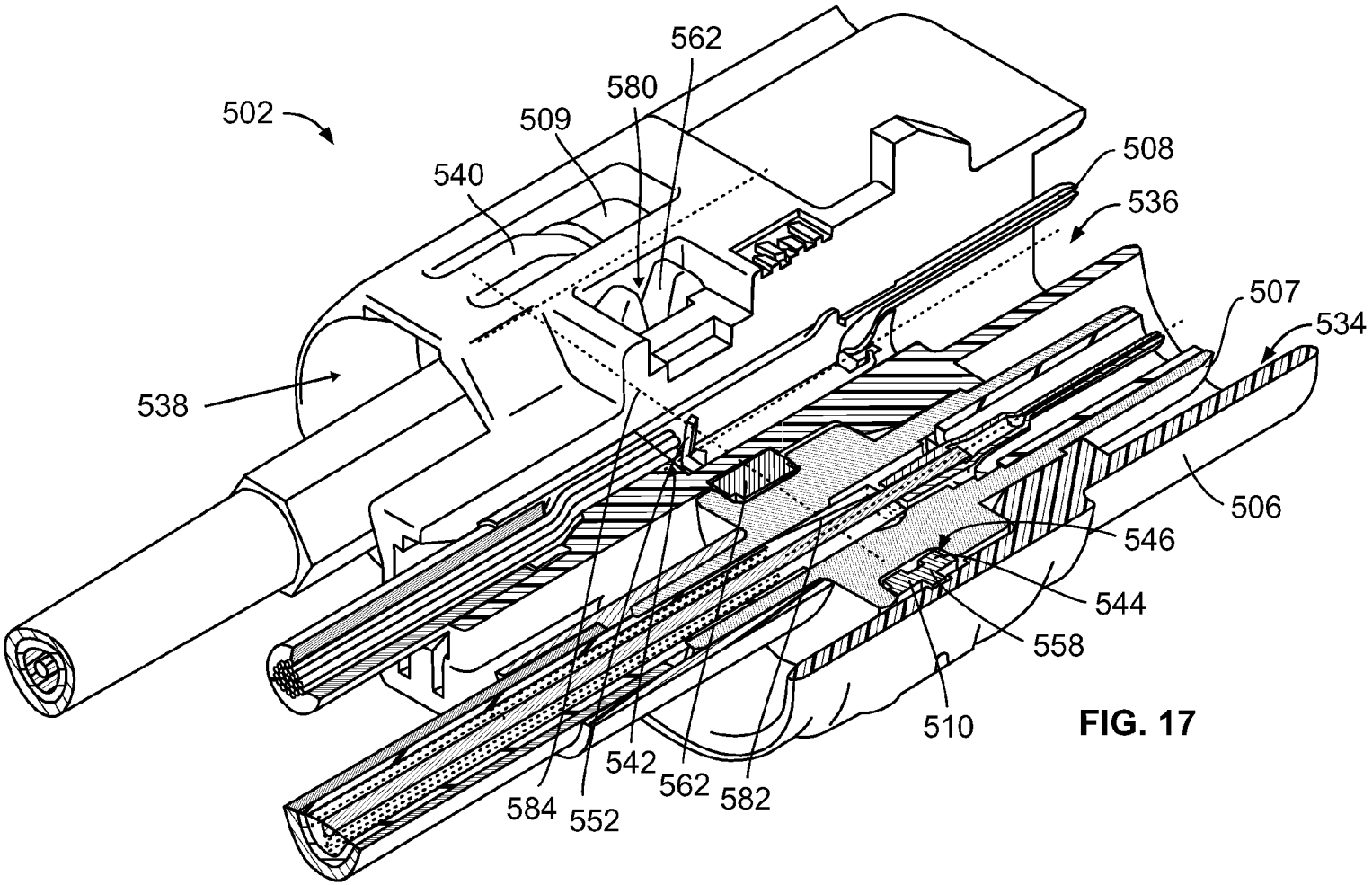
FIG. 17 is a perspective cut-away view of the jack assembly shown in FIG. 16.

FIG. 17 is a perspective cut-away view of the jack assembly 502 illustrating the jack connectors 507, 508, 509 loaded into the connector cavities 534, 536, 538 in the jack housing 506. The retention lock 510 is also illustrated in a loaded position within a locking chamber 580 of the jack housing 506. The posts 562 of the retention lock 510 are positioned between each of the jack connectors 507, 508, 509. For example, one of the posts 562 is between the first and second jack connectors 507, 508 and the other post 562 is between the second and third jack connectors 508, 509. In an exemplary embodiment, the posts 562 intersect a respective axis bi-sector 582, 584 extending between the adjacent jack connectors 507, 508 and 508, 509, respectively.

When assembled, the retention lock 510 engages the lock engagement surfaces 544 of the jack connectors 507, 509. In an exemplary embodiment, the first outer leg 558 of the retention lock 510 is located in the groove 546 along an outer portion of the jack connector 507, and the post 562 of the retention lock 510 is located in the groove 546 along an inner portion of the jack connector 507. The retention lock 510 thus retains the jack connector 508 in the jack housing 506. In an exemplary embodiment, the first outer leg 558 operates as a secondary locking feature to supplement the primary retention feature 540 of the jack housing 506. The retention lock 510 operates to hold the third jack connector 509 in a similar manner.

FIG. 17 also illustrates the primary retention feature 542 (e.g. the primary latch 542) engaging the lock engagement surface 552 to lock the second jack connector 508 within the second connector cavity 536. A portion of the primary latch 542 is positioned between the center leg 564 (shown in FIG. 16) and the second jack connector 508. The center leg 564 of the retention lock 510 backs up the primary latch 542 to hold the primary latch 542 in a locking position. The center leg 564 thus operates as a secondary locking feature.

Figure 18:
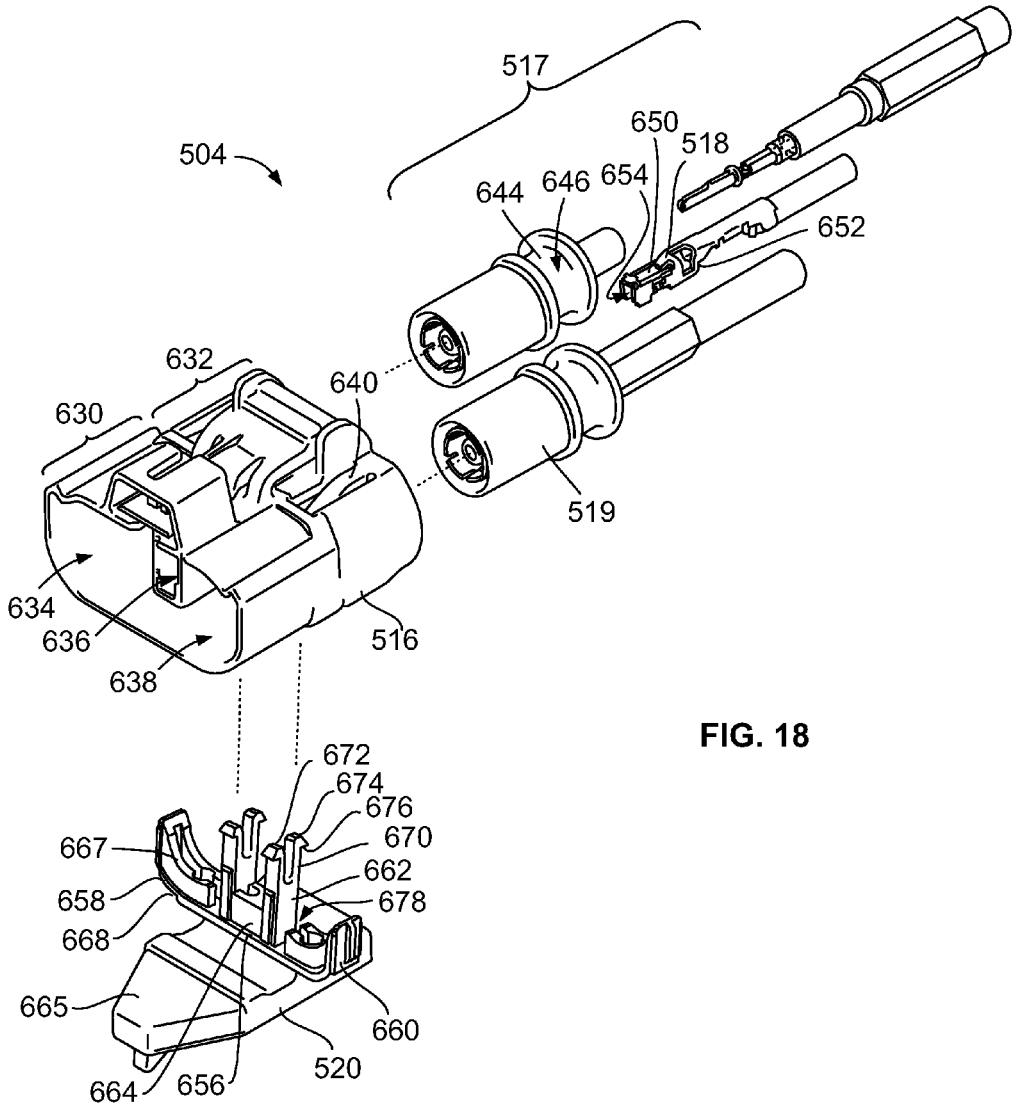
FIG. 18 is an exploded perspective view of the plug assembly shown in FIG. 15.

FIG. 18 is an exploded perspective view of the plug assembly 504. The plug housing 516 includes a mating section 630 and a connector retention section 632. First, second and third connector cavities 634, 636, 638 extend through the mating section 630 and the connector retention section 632. The connector cavities 634, 636, 638 receive the plug connectors 517, 518, 519, respectively. The plug housing 516 and plug retention lock 520 cooperate to hold the plug connectors 517, 518, 519 in the connector cavities 634, 636, 638. In an exemplary embodiment, the connector cavities 634, 636, 638 are generally aligned along a common centerline such that the plug connectors 517, 518, 519 are aligned with one another. In an exemplary embodiment, the first and third connector cavities 634, 638 are substantially identical to one another and positioned on both sides of the second connector cavity 636, which is different than the first and third connector cavities 634, 638.

In an exemplary embodiment, the connector retention section 632 includes primary retention features 640 extending into the first and third connector cavities 634, 638 for locating and holding the outer plug connectors 517, 519 within the connector cavities 634, 638, respectively. As will be described in further detail below, a different type of primary retention feature, represented by a primary latch 642 (shown in FIG. 20), extends into the second connector cavity 636 for locating and holding the middle plug connector 518. The primary retention features hold the plug connectors 517, 518, 519 in an installed position and cooperate with the plug retention lock 520 to lock the plug connectors 517, 518, 519 within the respective connector cavities 634, 636, 638.

In the illustrated embodiment, the first and third plug connectors 517, 519 are represented by SMB type connectors. Optionally, the first and third plug connectors 517, 519 are substantially identical to one another. The discussion below focuses on the first plug connector 517, but it is realized that the third plug connector 519 includes similar features. The first plug connector 517 includes a lock engagement surface 644 configured to engage the retention lock 520 and/or the primary retention feature. The first plug connector 517 includes a circumferential groove 646.

The second plug connector 518 is represented by a plug wire terminal type connector. The second plug connector 518 is terminated to the end of a wire, such as by a crimp connection. The plug connector 518 includes a connector body 650 having a lock engagement surface 652 proximate a rear end thereof. The plug connector 518 includes a socket 654 at a front of the body 650. The socket 654 is configured to mate with the second jack connector 508 (shown in FIG. 16).

The retention lock 520 includes a bottom beam 656, first and second outer legs 658, 660, a pair of split center posts 662, and a center leg 664 extending between the center posts 662. In the illustrated embodiment, the retention lock 520 includes a body clip provision 665. The outer legs 658, 660 have a generally arcuate inner surface 667 and a generally arcuate outer surface 668. The outer surfaces 668 and the bottom beam 656 are shaped to complement the shape of the plug housing 516 when coupled thereto. The first outer leg 658 and one of the posts 662 cooperate to secure the first plug connector 517 within the plug housing 516. The second outer leg 660 and the other post 662 cooperate to secure the third plug connector 519 within the plug housing 516. The center leg 664 extends parallel to the bottom beam 656. The split center posts 662 each include two adjacent center beams 670 extending perpendicular to the bottom beam 656 to a top latch 672. The center beams 670 are deflectable toward one another. Each top latch 672 includes an upper ramp surface 674 and a latching surface 676.

The retention lock 520 includes two slots 678 formed in the bottom beam 656. The slots 678 are located between the respective outer legs 658. 660 and the posts 662. In the illustrated embodiment, the slots 678 are located adjacent to the posts 662. The slots 678 are located to align with rails 684 (shown in FIG. 19) of the plug housing 516.

Figure 19:
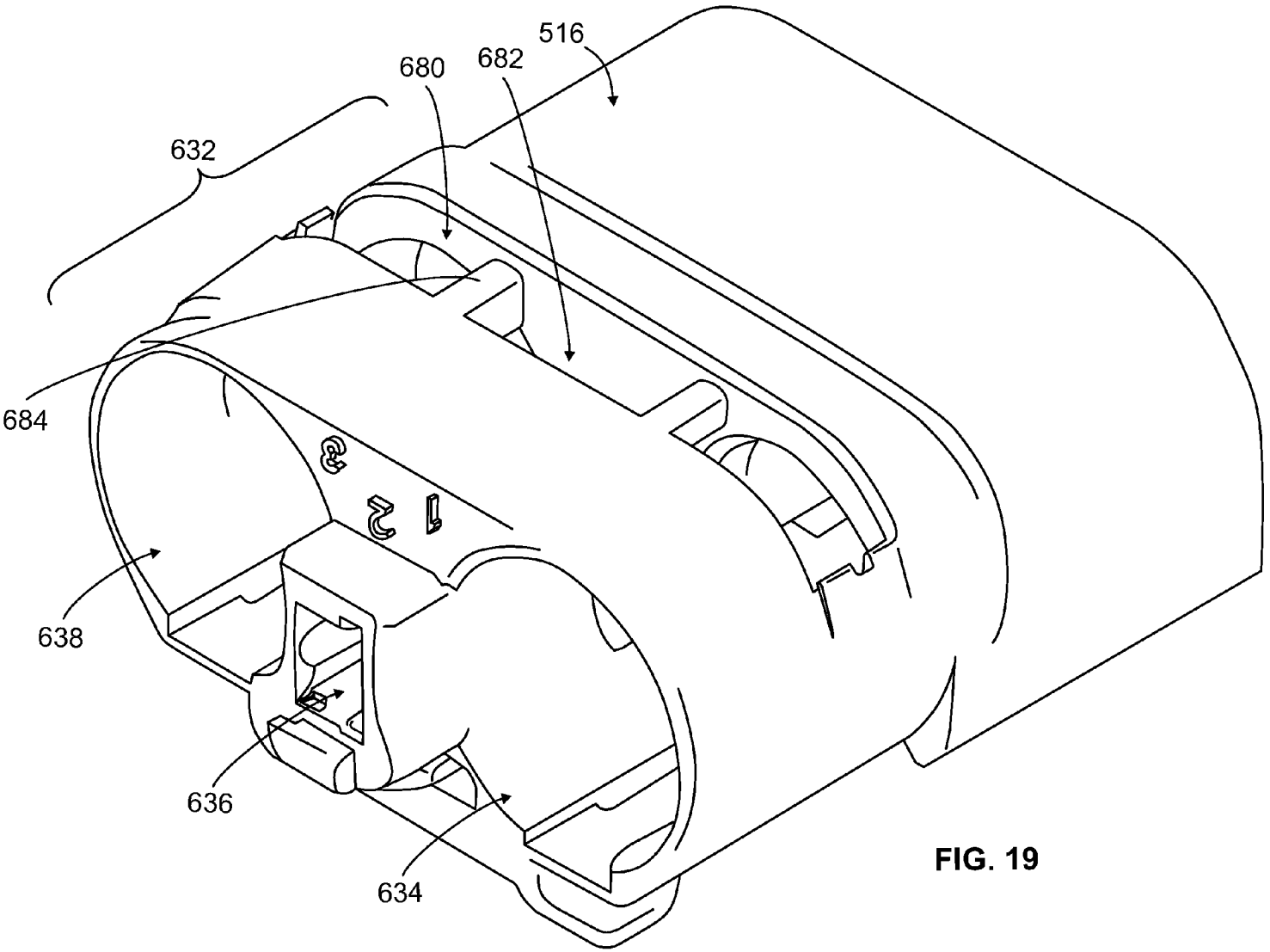
FIG. 19 is a bottom perspective view of a plug housing of the plug assembly shown in FIG. 15.

FIG. 19 is a bottom perspective view of the plug housing 516 of the plug assembly 504 (shown in FIG. 15). The connector retention section 632 of the plug housing 516 includes a slot 680 opening to a locking chamber 682 defined within the plug housing 516. The locking chamber 682 opens to each of the connector cavities 634, 636, 638. The slot 680 extends across the plug housing 516 perpendicular to the central axes of the connector cavities 634, 636, 638. In an exemplary embodiment, the slot 680 extends over all three connector cavities 634. 636, 638. The plug housing 516 includes at least one rail 684 extending across the slot 680 in the direction of the central axes. In the illustrated embodiment, the plug housing 516 includes two rails 684 extending across the first and third connector cavities 634, 638 to support the first and third plug connectors 517, 519 (shown in FIG. 18), respectively. Optionally, the rails may be positioned inwardly offset from the respective centerline of the connector cavities 634, 638. As will be further described below, the rails 684 assist in the assembly of the plug connectors 517, 519 and/or the plug retention lock 520 into the plug housing 516.

Figure 20:
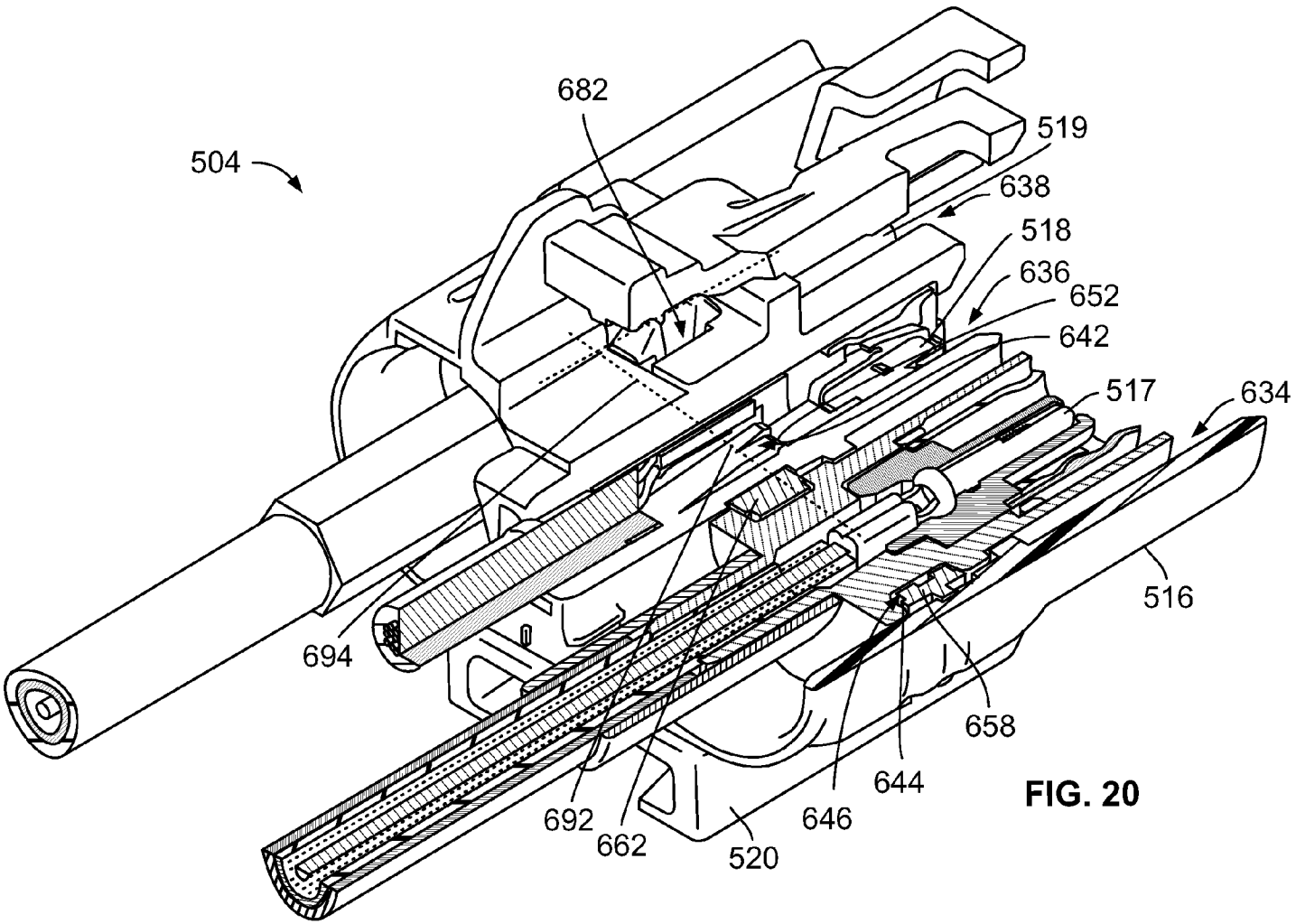
FIG. 20 is a perspective cut-away view of the plug assembly shown in FIG. 18.

FIG. 20 is a perspective cut-away view of the plug assembly 504 illustrating the plug connectors 517, 518, 519 loaded into the connector cavities 634, 636, 638 in the plug housing 516. The retention lock 520 is also illustrated in a loaded position within a locking chamber 682 of the plug housing 516. The posts 662 of the retention lock 520 are positioned between each of the plug connectors 517, 518, 519. For example, one of the posts 662 is between the first and second plug connectors 517, 518 and the other post 662 is between the second and third plug connectors 518, 519. In an exemplary embodiment, the posts 662 intersect a respective axis bi-sector 692, 694 extending between the adjacent plug connectors 517, 518 and 518, 519, respectively.

When assembled, the retention lock 520 engages the lock engagement surfaces 644 of the plug connectors 517, 519. In an exemplary embodiment, the first outer leg 658 of the retention lock 520 is located in the groove 646 along an outer portion of the plug connector 517, and the post 662 of the retention lock 520 is located in the groove 646 along an inner portion of the plug connector 517. The retention lock 520 thus retains the plug connector 517 in the plug housing 516. In an exemplary embodiment, the first outer leg 658 operates as a secondary locking feature to supplement the primary retention feature of the plug housing 516. The retention lock 520 operates to hold the third plug connector 519 in a similar manner.

FIG. 20 also illustrates the primary retention feature 642 (e.g. the primary latch 642) engaging the lock engagement surface 652 to lock the second plug connector 518 within the second connector cavity 636. A portion of the primary latch 642 is positioned between the center leg 664 (shown in FIG. 18) and the second plug connector 518. The center leg 664 of the retention lock 520 backs up the primary latch 642 to hold the primary latch 642 in a locking position. The center leg 664 thus operates as a secondary locking feature.

Electrical connector systems are provided that include plug and jack assemblies having plug and jack connectors, respectively. Each assembly includes a plurality of connectors that are aligned with one another. The centerlines of each of the connectors are aligned with one another. Optionally, the assemblies include at least one SMB type connector. Some embodiments include only SMB type connectors. Other embodiments include other types of connectors in addition to the SMB connector(s), such as wire terminal type connectors that are terminated to the end of a cable. Each of the assemblies includes a primary retention feature for each connector. Optionally, the primary retention feature may be a latch extending into the cavity holding the connector. Each of the assemblies includes a retention lock that functions as a secondary locking feature as a back up to the primary retention feature. The secondary locking feature may directly engage the connector, or alternatively, may back up the primary retention feature to ensure that the connector is locked in the cavity. In an exemplary embodiment, each SMB type of connector includes a groove and the retention lock fits in the groove to secure the connector in the respective cavity. The retention lock includes at least one split beam post that has a top latch received in a locking chamber in the respective housing to secure the retention lock in the housing. The post extends between adjacent contacts. Each housing includes a slot through which the retention lock is loaded, and each slot includes at least one rail extending across the slot. The rail supports the connector in the respective cavity to keep the connector in the cavity and prevent the connector from falling into the slot, which would cause the connector to be misaligned within the cavity and/or block the retention lock from loading into the locking chamber.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

What is claimed is:

1. An electrical connector assembly comprising:

a housing having more than one cavity extending along an insertion axis for inserting a connector in each of the more than one cavity, the housing having a slot extending perpendicular to the insertion axis, wherein the slot includes at least one rail extending across the slot parallel to the insertion axis, the housing having a locking chamber therethrough including a first section and a wider second section; and a retention lock inserted into the slot and held within the housing, the retention lock having a split center post with a top latch, wherein the retention lock passes through the locking chamber so that the top latch locks within the wider second section of the locking chamber, wherein the retention lock locks each of the more than one connector within each cavity.

2. The electrical connector assembly of claim 1, wherein the retention lock is configured to engage each connector for at least 120 degrees of the circumference of the connector.

3. The electrical connector assembly of claim 1, wherein the housing includes primary retention features for locking each connector in each cavity.

4. The electrical connector assembly of claim 1, wherein an axis bisector extends directly between adjacent ones of the insertion axes, the split center post intersecting the axis bisector when loaded into the locking chamber.

5. The electrical connector assembly of claim 1, wherein the retention lock includes at least one slot aligned with, and receiving, the at least one rail.

6. The electrical connector assembly of claim 1, wherein the retention lock includes outer legs for secondary locking of the connectors in the cavities.

7. An electrical connector assembly comprising:

a housing having connector cavities extending along parallel insertion axes, axis bisectors being defined between adjacent insertion axes, the housing having a locking chamber opening to each of the connector cavities;

a plurality of connectors received in respective connector cavities, at least one of the connectors being a SubMiniature version B (SMB) connector having a cylindrical body, the body having a lock engagement surface; and a retention lock received in the locking chamber to hold each of the connectors in the respective connector cavities against movement in a direction along the respective insertion axes, the retention lock including a post extending through each axis bisector, the retention lock directly engaging the lock engagement surface to secure the SMB connector in the housing.

8. The electrical connector assembly of claim 7, wherein each of the connectors are SMB connectors.

9. The electrical connector assembly of claim 7, wherein the retention lock includes an outer leg, the outer leg engaging the lock engagement surface of the SMB connector.

10. The electrical connector assembly of claim 7, wherein each of the connectors are aligned on a common centerline.

11. The electrical connector assembly of claim 7, wherein the lock includes an outer leg cooperating with the adjacent post to circumferentially engage the lock engagement surface around approximately half of the body.

12. The electrical connector assembly of claim 7, wherein the retention lock is inserted into the locking chamber through a slot, and each post includes a top latch at a distal end thereof engaging a ledge formed in the housing.

13. The electrical connector assembly of claim 7, wherein each post includes a pair of deflectable latches releasably engaging the housing to secure the retention lock in the locking chamber.

14. The electrical connector assembly of claim 7, wherein the housing includes a plurality of primary retention features, each primary retention feature extending into a corresponding connector cavity and engaging a corresponding connector.

15. The electrical connector assembly of claim 7, wherein at least one of the connectors is a wire terminal connector, the housing having a primary latch engaging the wire terminal connector, the retention lock having a leg engaging the primary latch for secondary locking of the primary latch.

16. An electrical connector assembly comprising:

a housing having connector cavities extending along parallel insertion axes, the housing defining primary retention features extending into the connector cavities, the housing having a locking chamber opening to each of the connector cavities;

an SMB connector received in one of the connector cavities and being held therein by one of the primary retention features, the SMB connector having a cylindrical body and a lock engagement surface;

a wire terminal connector received in one of the connector cavities, the wire terminal connector having a lock engagement surface, wherein one of the primary retention features engages the lock engagement surface of the wire terminal connector; and a retention lock received in the locking chamber to hold each of the connectors in the respective connector cavities, the retention lock having a first leg engaging the lock engagement surface of the SMB connector to hold the SMB connector in the connector cavity, and the retention lock having a second leg engaging the primary retention feature that engages the lock engagement surface of the wire terminal connector for secondary locking of the primary retention feature.

17. The electrical connector assembly of claim 16, wherein the retention lock circumferentially engages the SMB connector around approximately half of the body.

18. The electrical connector assembly of claim 16, wherein the primary retention feature is positioned between the wire terminal connector and the second leg.

19. The electrical connector assembly of claim 16, wherein the retention lock includes a post extending between the SMB connector and the wire terminal connector.

20. The electrical connector assembly of claim 16, further comprising a second SMB connector received in one of the connector cavities and being held therein by one of the primary retention features, wherein the SMB connector, the second SMB connector and the wire terminal connector are substantially aligned along a common centerline.

* * * * *